US005899649A

United States Patent [19]

Kohtani et al.

[11] Patent Number: 5,899,649

[45] Date of Patent: May 4, 1999

[54] BOOK-BINDING APPARATUS AND IMAGE FORMING APPARATUS

[75] Inventors: Hideto Kohtani, Yokohama; Katsunari Suzuki, Kawasaki; Daisuke Ishizuka, Yokohama, all of Japan

[73] Assignee: Canon Kabushiki Kaisha, Tokyo, Japan

[21] Appl. No.: 08/733,005

[22] Filed: Oct. 16, 1996

[30] Foreign Application Priority Data

Oct. 17, 1995 [JP] Japan ..... 7-268367

[51] Int. Cl.[6] ..... B42C 9/00

[52] U.S. Cl. ..... 412/11; 412/9; 412/14; 412/33; 412/37; 412/900; 412/901; 412/902

[58] Field of Search ..... 412/9, 11, 12, 412/14, 33, 34, 37, 900, 901, 902

[56] References Cited

U.S. PATENT DOCUMENTS 5,569,011 10/1996 Yamaguchi et al. ..... 412/33
5,569,012 10/1996 Kosasa et al. ..... 412/33

*Primary Examiner*—Frances Han
*Attorney, Agent, or Firm*—Fitzpatrick, Cella, Harper & Scinto

[57] ABSTRACT

A book-binding apparatus conveying a bind tape in front of a tape heater and an aligned sheet bundle is urged against the bind tape pre-heated by the tape heater to glue a plurality of sheets by melted adhesive on the bind tape. An aligning time for the sheet bundle is calculated on the basis of attributes of the sheets being aligned and a conveyance start timing for the bind tape is changed in accordance with the calculated aligning time.

9 Claims, 29 Drawing Sheets

FIG. 33

| SHEET NUMBER (i) | SHEET SIZE | SHEET ORIENTATION | SUPPLY DECK | PROCESS TREATMENT 1 | PROCESS TREATMENT 2 |
|---|---|---|---|---|---|
| 1 | A4 | LONGITUDINAL | 6 | NO | NO |
| 2 | A4 | LONGITUDINAL | 6 | BOTH FACE | NO |
| 3 | A4 | LONGITUDINAL | 6 | BOTH FACE | NO |
| 4 | A3 | LATERAL | 7 | Z-FOLD | NO |
| 5 | A3 | LATERAL | 7 | BOTH FACE | Z-FOLD |
| • | • | | | | |
| • | • | | | | |
| • | • | | | | |
| n-2 | A4 | LONGITUDINAL | 6 | BOTH FACE | NO |
| n-1 | A4 | LONGITUDINAL | 6 | NO | NO |
| n | A4 | LONGITUDINAL | 6 | NO | NO |

BOOK-BINDING APPARATUS AND IMAGE FORMING APPARATUS

BACKGROUND OF THE INVENTION

1. Field of the Invention

The present invention relates to a book-binding apparatus for automatically gluing a sheet bundle to book-bind it.

2. Related Background Art

There have been proposed on-line systems in which a series of operations from an image forming operation to a book-binding operation for book-binding a sheet bundle discharged from an image forming apparatus and comprised of sheets on which images were formed are performed continuously. In such on-line systems, a plurality of imaged sheets (sheet bundle) are book-bound by gluing the sheet bundle. In this gluing and book-binding operation, a strip-shaped bind tape on which hot melt adhesive is coated is used.

When a plurality of imaged sheets being moved through the on-line system are book-bound, first of all, the plurality of imaged sheets being moved are stacked on an alignment tray to align the sheets with each other as a sheet bundle. Then, the aligned sheet bundle is sent to a book-binding portion, where a bound edge of the sheet bundle is urged against a bind tape which was pre-heated by a tape heating means (heaters). As a result, adhesive coated on the bind tape flows into between the sheets, thereby gluing the sheet bundle.

Normally, the bind tape is wound around a tape reel, and, whenever a sheet bundle is book-bound, the bind tape is supplied from the tape reel and is then cut to a predetermined length by a cutter. The cut tape is sent to the book-binding portion. The strip-shaped bind tape cut to the predetermined length is set at the book-binding portion and is previously heated by the tape heating means before the aligned sheet bundle is conveyed to the book-binding portion. The pre-heating time for the bind tape is determined by the material of the adhesive, and the strip-shaped bind tape is conveyed to the book-binding portion in consideration of the pre-heating time. Meanwhile, the tape heating means is maintained in an ON condition to reach a temperature optimum to pre-heat the bind tape. (The reason for pre-heating the bind tape is that the adhesive is melted to an appropriate condition to perform high quality gluing.)

In case of the conventional on-line systems (book-binding apparatuses), a timing for conveying the strip-shaped bind tape to the book-binding portion (bind tape conveying timing) is determined to start at a time point when a predetermined time period is elapsed from the initiation of the book-binding operation. However, as is in the present days, when sheets having various different attributes are to be book-bound, in the above-mentioned conventional on-line systems, the productivity of the entire system may be decreased or the high quality gluing cannot often be performed.

That is to say, as is in the above-mentioned conventional on-line systems, when the strip-shaped bind tape is conveyed to the book-binding portion at the predetermined conveying timing, regarding a sheet bundle which can be aligned earlier, the conveying timing for conveying the sheet bundle to the book-binding portion must be delayed so that the sheet bundle is prevented from being conveyed to the book-binding portion before the pre-heating of the bind tape is finished. Consequently, the total book-binding time is lengthened, thereby decreasing the productivity of the entire system. On the other hand, regarding a sheet bundle which can be aligned later, since the sheet bundle cannot reach the book-binding portion immediately after the pre-heating of the bind tape is finished, the adhesive is melt excessively, thereby making the high quality gluing impossible.

Incidentally, in this specification, factors for determining the alignment time of the sheet bundle (for example, a size of the sheet, a conveying direction of the sheet, and post-treatment of the sheet) are referred to as "attributes" of the sheet.

SUMMARY OF THE INVENTION

The present invention aims to eliminate the above-mentioned conventional drawbacks, and an object of the present invention is to provide a book-binding apparatus in which, regarding various sheets bundles having different attributes, productivity is not decreased and high quality gluing can be performed.

To achieve the above object, according to the present invention, there is provided a book-binding apparatus wherein a bind tape is conveyed in front of a tape heating means and an aligned sheet bundle is urged against the bind tape pre-heated by the tape heating means to glue a plurality of sheets by melt adhesive on the bind tape, and further an aligning time for the sheet bundle is calculated on the basis of an attribute of the sheet being aligned and a conveyance start timing for the bind tape is changed in accordance with the calculated aligning time.

Further, the book-binding apparatus according to the present invention may include an attribute determining means for determining the attribute of the sheets being aligned, and a tape conveyance start timing setting means for calculating the aligning time for the sheet bundle on the basis of the attribute of the sheet determined by the attribute determining means and for setting the conveyance start timing for the bind tape in accordance with the aligning time.

BRIEF DESCRIPTION OF THE DRAWINGS

FIG. 33 is an explanatory view showing attributes provided by the CPU for the image forming apparatus.

DETAILED DESCRIPTION OF THE PREFERRED EMBODIMENTS

Figure 1:
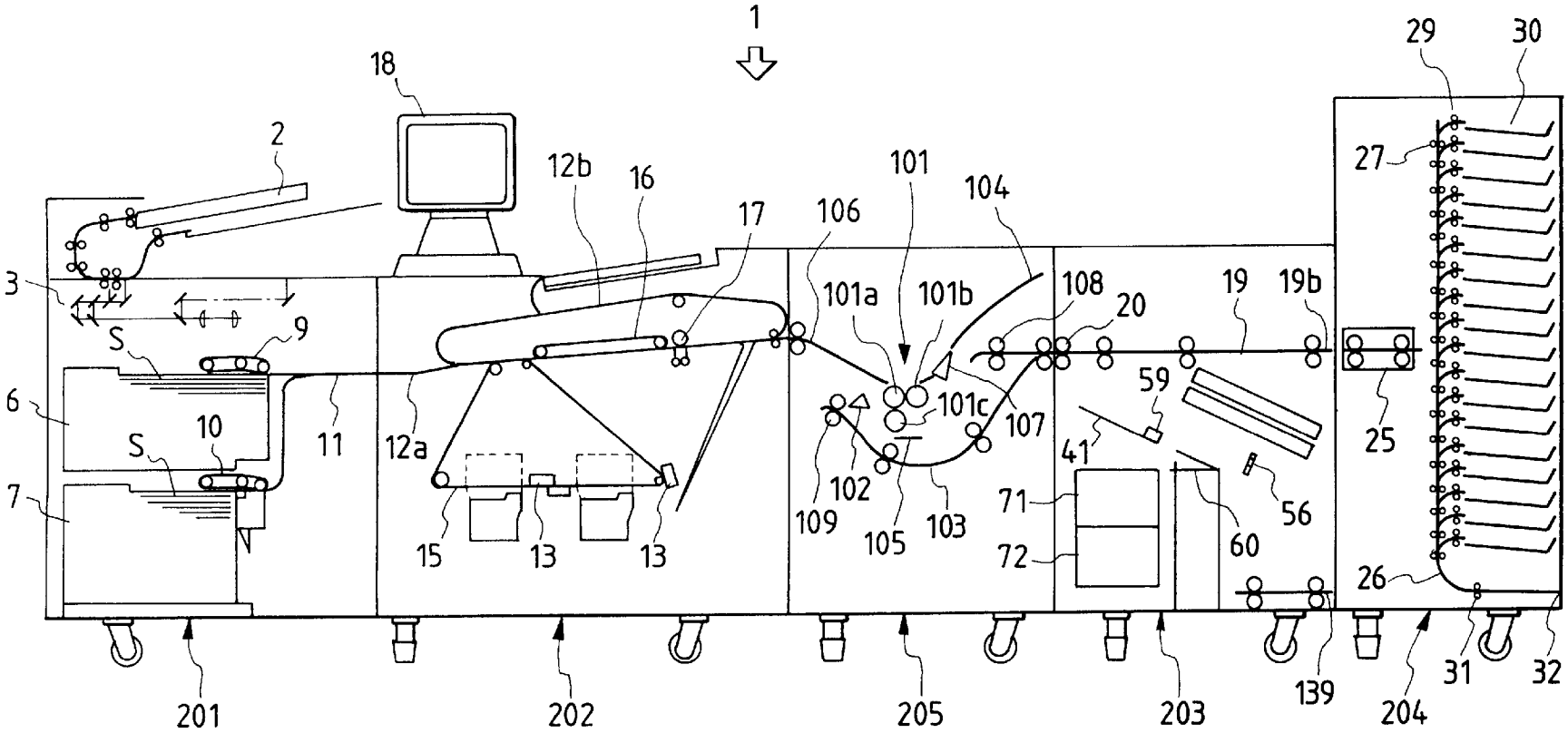
FIG. 1 is a schematic elevational sectional view of an entire on-line system including a book-binding apparatus according to the present invention.

FIG. 1 shows an entire construction of an on-line system to which the present invention is applied. The on-line system 1 comprises a reading and sheet supplying apparatus 201, an image forming apparatus 202, a sheet folding apparatus 205, a book-binding apparatus 203 and a sorting and containing apparatus 204, which apparatuses are connected to each other in series.

The reading and sheet supplying apparatus 201 is provided at its upper side with an original setting portion 2 for setting originals (not shown) and an optical system 3 for reading and scanning the original set by the original setting portion 2 and is further provided at its lower side with a sheet supply decks 6, 7 containing sheets S having different sizes and sheet supply portions 9, 10 for supplying the sheet S.

The sheet S supplied from the sheet supply deck 6 or 7 is sent to a sheet convey path 12a of the downstream image forming apparatus 202 through a sheet convey path 11. A sheet convey path 12*b* connected to the sheet convey path 12*a* acts as a both-face path used when images are formed on both surface of the sheet S. The reference numeral 13 denotes LED heads for effecting a scanning operation on the basis of image information read by the optical system 3; and 15 denotes an image forming portion where a toner image is formed after the scanning operation.

The sheet S on which the image was formed at the image forming portion 15 is sent to a sheet convey path 106 of the downstream sheet Z-folding apparatus 205 via a convey belt 16 and a pair of convey rollers 17. Incidentally, the reference numeral 18 denotes an operation portion for selecting the deck 6 or 7 to be used and for permitting an operator to set whether post-treatment(s) is performed by using the downstream post-treatment apparatus(s) 205, 203 and/or 204.

When the sheet S is not Z-folded by the sheet Z-folding apparatus 205, a flapper 107 is laid toward a pair of convey rollers 108, so that the sheet S is conveyed to an outlet. On the other hand, when the sheet is Z-folded, a tip end of the elongated sheet S to be folded is firstly urged against a first shutter 104 shifted to a position corresponding to the length of the sheet and a first folding line is formed in the sheet by using folding rollers 110*a*, 101*b*. Then, the sheet is shifted downwardly to abut the first folding line against a second shutter shifted to a position corresponding to the length of the sheet and the sheet is moved to the left while forming a second folding line in the sheet by using the folding rollers 101*a*, 101*c*. In this case, although a flapper 102 is lifted upwardly in order to send a folded sheet to a pair of reverse rotation rollers 109, after the folded sheet leaves the folding rollers 101, the flapper 102 is lowered in order to send the folded sheet toward the outlet. Lastly, the pair of reverse rotation rollers 109 are rotated reversely to feed the folded sheet S through a sheet convey path 103 toward the outlet. Thereafter, the folded sheet S is sent to a sheet convey path 19 of the downstream book-binding apparatus 203.

The book-binding apparatus 203 includes a sheet align tray 41 for containing and aligning the sheet S branched from the sheet convey path 19, an abutment member 59 against which the tip end of the sheet abuts, a tape heating device 56 for heating the aligned sheet bundle and a bind tape, a lift/lower carriage 60 having a handling member for handling a book-bound sheet bundle, and stackers 71, 72 for containing the book-bound sheet bundle. Further, the book-binding apparatus 203 is provided with a stacking tray (not shown) for stacking the sheets discharged through a first discharge opening 19*b* and a stacking tray (not shown) for stacking the book-bound sheet bundles discharged through a second discharge opening 139.

In the sorting and containing apparatus 204, the reference numeral 25 denotes an elevator for transferring the sheet S from the sheet convey path 19 to a convey path 26; 27 denotes pairs of convey rollers disposed at respective branch portions of the convey path 26; and 29 denotes pairs of discharge rollers for discharging the sheets branched at the branch portions onto corresponding discharge trays 30. The book-bound sheet bundle discharged from the second discharge opening 139 can be discharged through a discharge opening 32 via the elevator 25 and a pair of convey rollers 31.

Figure 2:
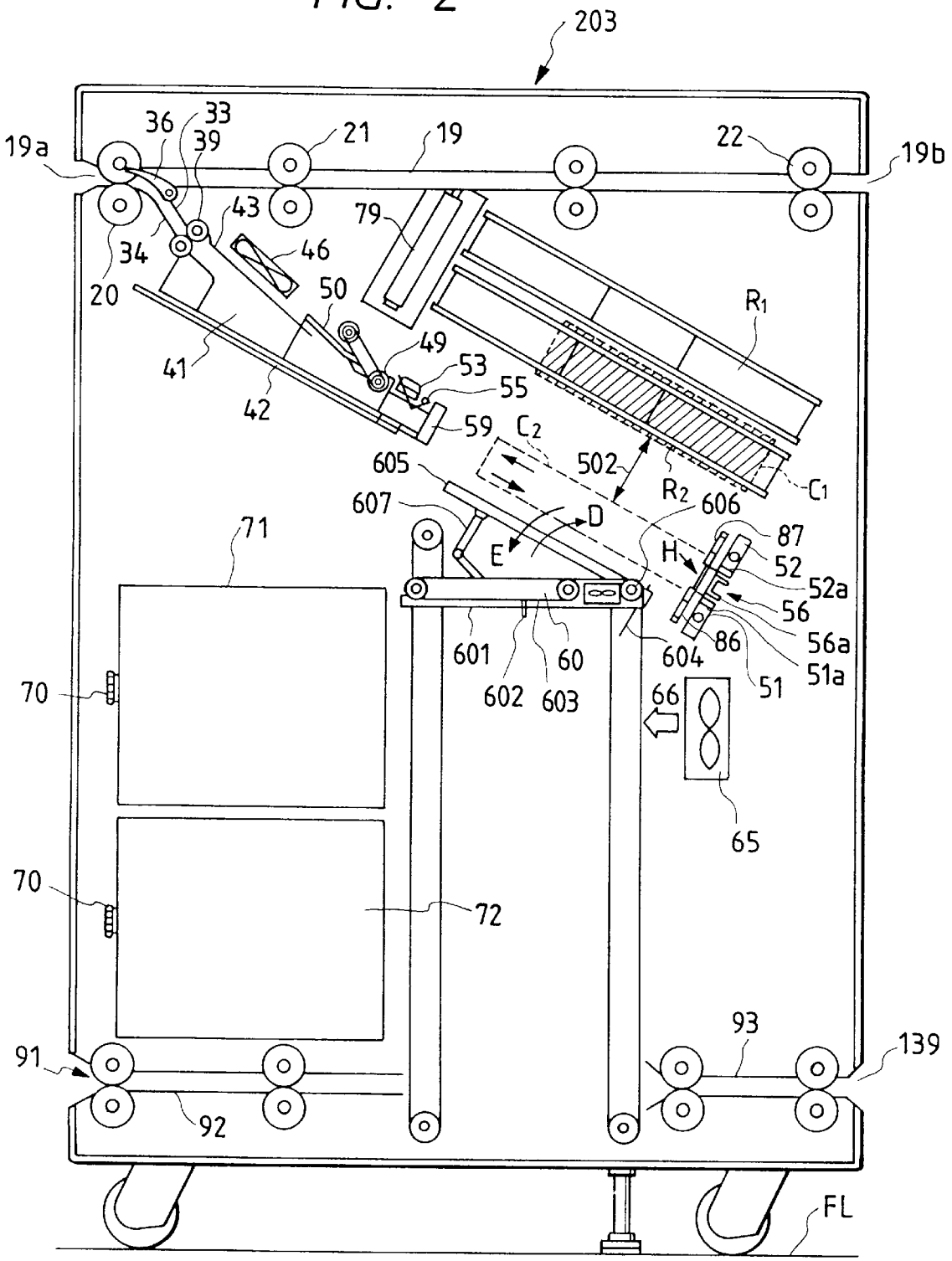
FIG. 2 is an elevational sectional view of the book-binding apparatus.

FIG. 2 shows a detailed construction of the book-binding apparatus 203.

A branch path including a flapper (branching means) 36 and upper and lower guide plates 33, 34 is provided in the vicinity of a pair of convey-in rollers 20 at a downstream side thereof. When the flapper 36 is shifted to a position as shown, the sheet S conveyed by the pair of convey-in rollers 20 is directed to the branch path including the guide plates 33, 34. On the other hand, when the flapper 36 is switched from the illustrated position, the sheet S is conveyed toward a downstream direction through the sheet convey path 19. At a downstream side of the branch path including the guide plates 33, 34, there is provided the sheet align tray 41 having an upper guide plate 43 in such a manner that a downstream end of the tray becomes lower than an upstream end thereof. The abutment member 59 is provided at the downstream end of the tray.

The sheet S conveyed to the sheet align tray 41 by the pair of convey rollers 39 is shifted to abut against the abutment member 59 by a sweeper member 49 comprised of a belt rockable around a left upper end thereof, thereby aligning the sheets. Further, the alignment of the sheets in a sheet width-wise direction is performed by abutting the sheet against a reference member (not shown) by means of a side regulating member 50. A blower fan 46 disposed above the upper guide plate 43 serves to flatten the folded sheets conveyed on the align tray 41, thereby preventing the swelling of sheets.

The reference number 53 denotes a clamp member for pinching the sheet bundle therebetween; 42 denotes an auxiliary guide plate for the sheet bundle; and 55 denotes a stop finger (which is operated to discharge the sheet bundles after the sheet bundles forming a book are stored and which serves to store next several sheet bundles).

The carriage 60 for conveying the book-bound sheet bundle S1 includes a housing 601 supported by a rotatable chain for movement in an up-and-down direction, a convey belt 603 supported by the housing 601 for reversible rotational movement, a pushing member 602 moved in synchronism with the convey belt 603, a sheet bundle trail end supporting plate 604 for supporting the sheet bundle S1 (by abutting the trail end of the sheet bundle S1 conveyed by the auxiliary guide plate 42) and rockable around a support shaft 606 between a sheet bundle receiving position and a retard position, and a sheet bundle supporting rod 605 rockable around the support shaft 606 and supported by a link 607 and movable between a receiving position for receiving the sheet bundle S1 and a transfer position for transferring the sheet bundle to the belt 603. Incidentally, after the sheet bundle S1 is separated from the tape heating device 56 by the clamp member 53, the sheet bundle trail end supporting plate 604 is shifted to a position for supporting the end of the sheet bundle, and, when the clamp member 53 is separated from the sheet bundle S1, the end of the sheet bundle abuts against the plate 604, thereby supporting the sheet bundle S1.

Figure 4:
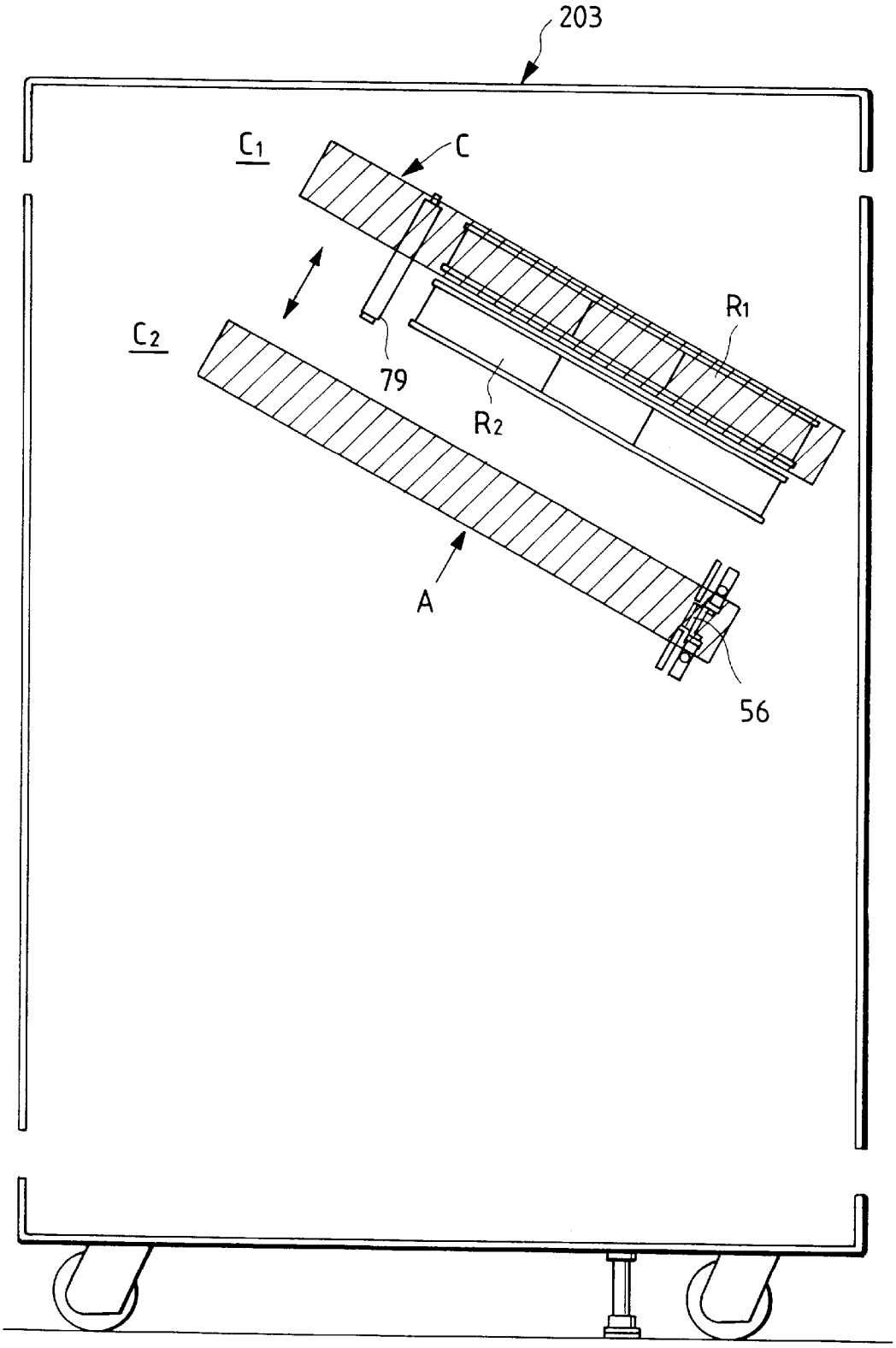
FIG. 4 is a side view showing a condition that the bind tape is conveyed from the tape reel by the carriage.

The symbol R1 denotes a first tape reel; and R2 denotes a second tape reel (FIG. 4). A bind tape 77 having a width l1 (thickness of sheet bundle+$\alpha$) is cut to a predetermined length l2 (corresponding to a width of the sheet bundle S1) by a cutter 79. A fan 65 for cooling the book-bound sheet bundle serves to flow air toward a direction shown by the arrow 66. The stackers 70, 71 for containing the book-bound sheet bundles can be retracted along rails 70.

Next, an operation for supplying the bind tape 77 from the first tape reel R1 will be explained with reference to FIGS. 3A to 5B.

A carriage C for feeding the bind tape 77 can be shifted in directions shown by the arrow 502 (FIG. 2) between a tape receiving position C1 for receiving the bind tape 77 from the first tape reel R1 and a tape supplying position C2 for supplying the bind tape 77 to the tape heating device 56 positioned at a back surface abutment position H.

Figure 3A:
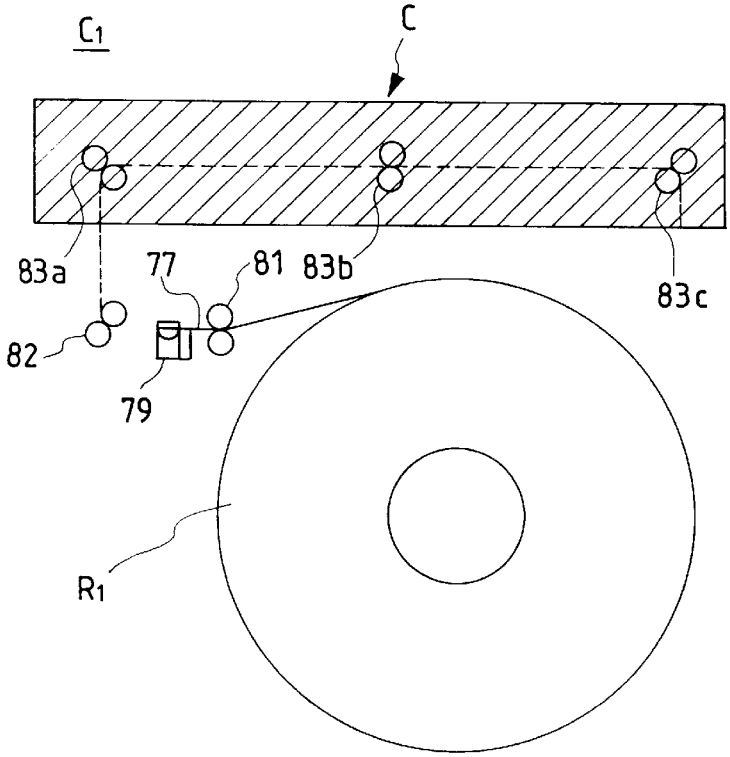
FIGS. 3A and 3B are plan views showing a condition that a bind tape is conveyed from a tape reel by a carriage.
Figure 3B:
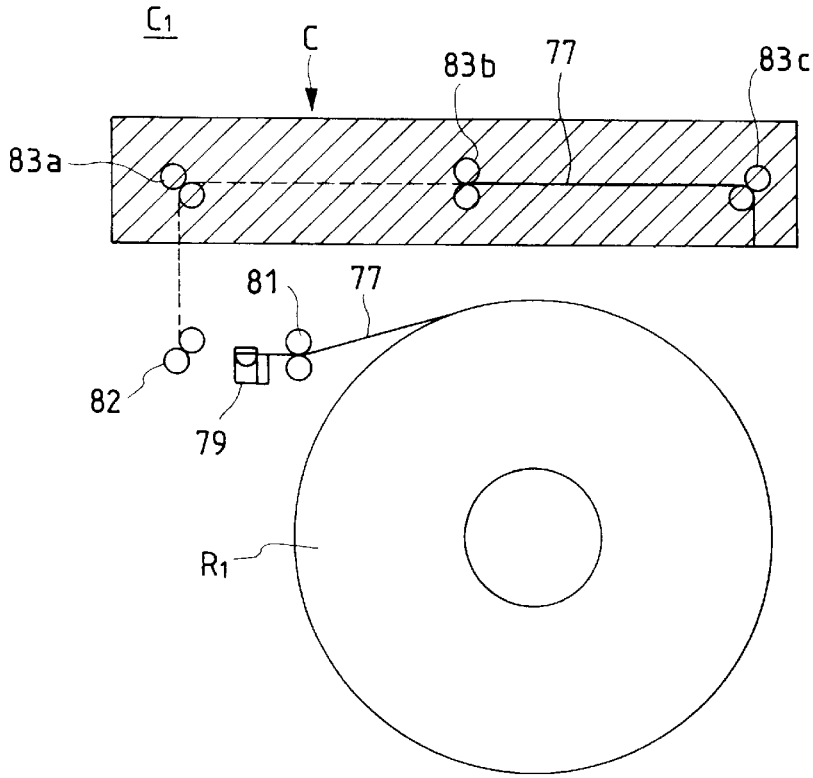

As shown in FIG. 3A, a tip end portion of the bind tape 77 wound around the reel R1 is fed out by the pair of convey rollers 81 to be positioned in front of the cutter 79. In use, the bind tape is further fed out by the pair of convey rollers 81 and is cut to the predetermined length by the cutter 79. The cut bind tape 77 is supplied, by the pair of convey rollers 82, to the carriage C positioned at the position C1, where, as shown in FIG. 3B, the bind tape is held and conveyed by pairs of rollers 83*a*, 83*b*, 83*c* included within the carriage C.

Figure 5A:
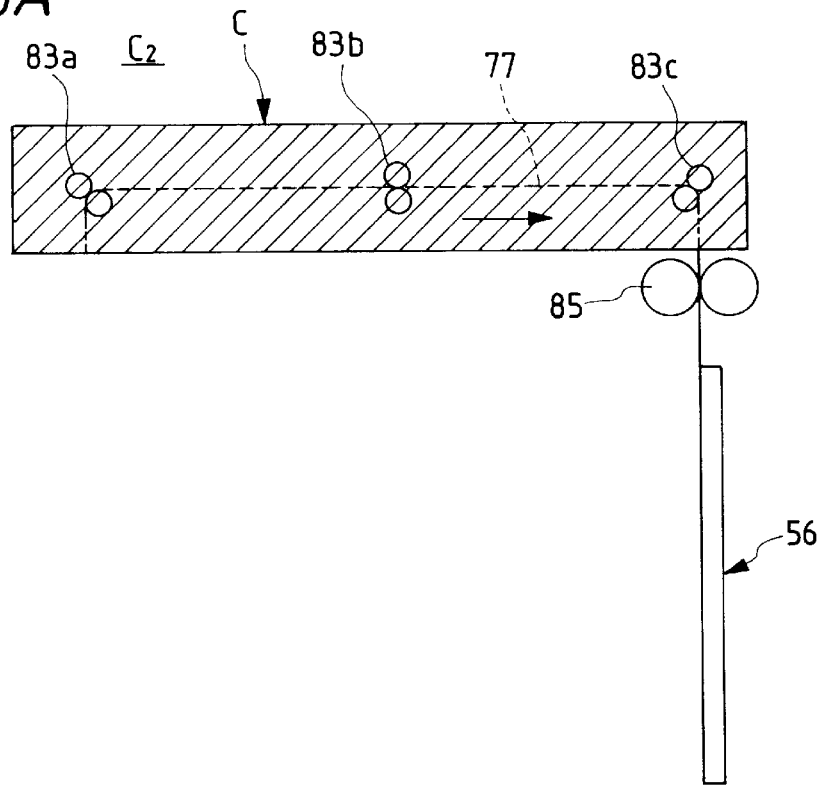
FIGS. 5A and 5B are plan views showing a condition that the bind tape is set at a tape heating device by the carriage.
Figure 5B:
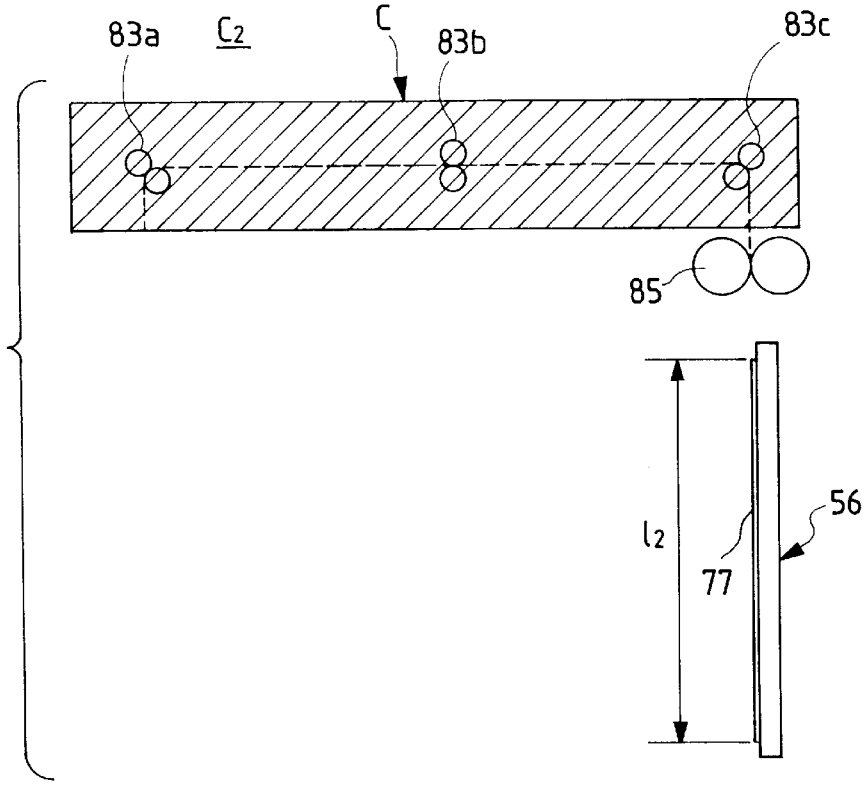

As shown in FIG. 4, the carriage C to which the bind tape 77 was supplied is shifted from the position C1 to the position C2, and as shown in FIG. 5A, the bind tape 77 is fed out toward a direction shown by the arrow by rotating the pairs of rollers 83*a*, 83*b*, 83*c*. The fed bind tape 77 is shifted, by a pair of convey rollers 85, to the tape heating device 56 positioned at the back surface abutment position H. FIG. 5B shows a condition that the bind tape 77 fed from the carriage C is set on the tape heating device 56. The tape heating device 56 is arranged to extend along a direction (direction perpendicular to the plane of FIG. 13) perpendicular to a line extending the height of the sheet bundle S1 at a downstream side of the sheet align tray 41.

FIGS. 6 to 9 show conditions that the sheets S are introduced into the sheet align tray 41 and the aligned sheet bundle S1 is shifted to the back surface abutment position H.

Figure 6:
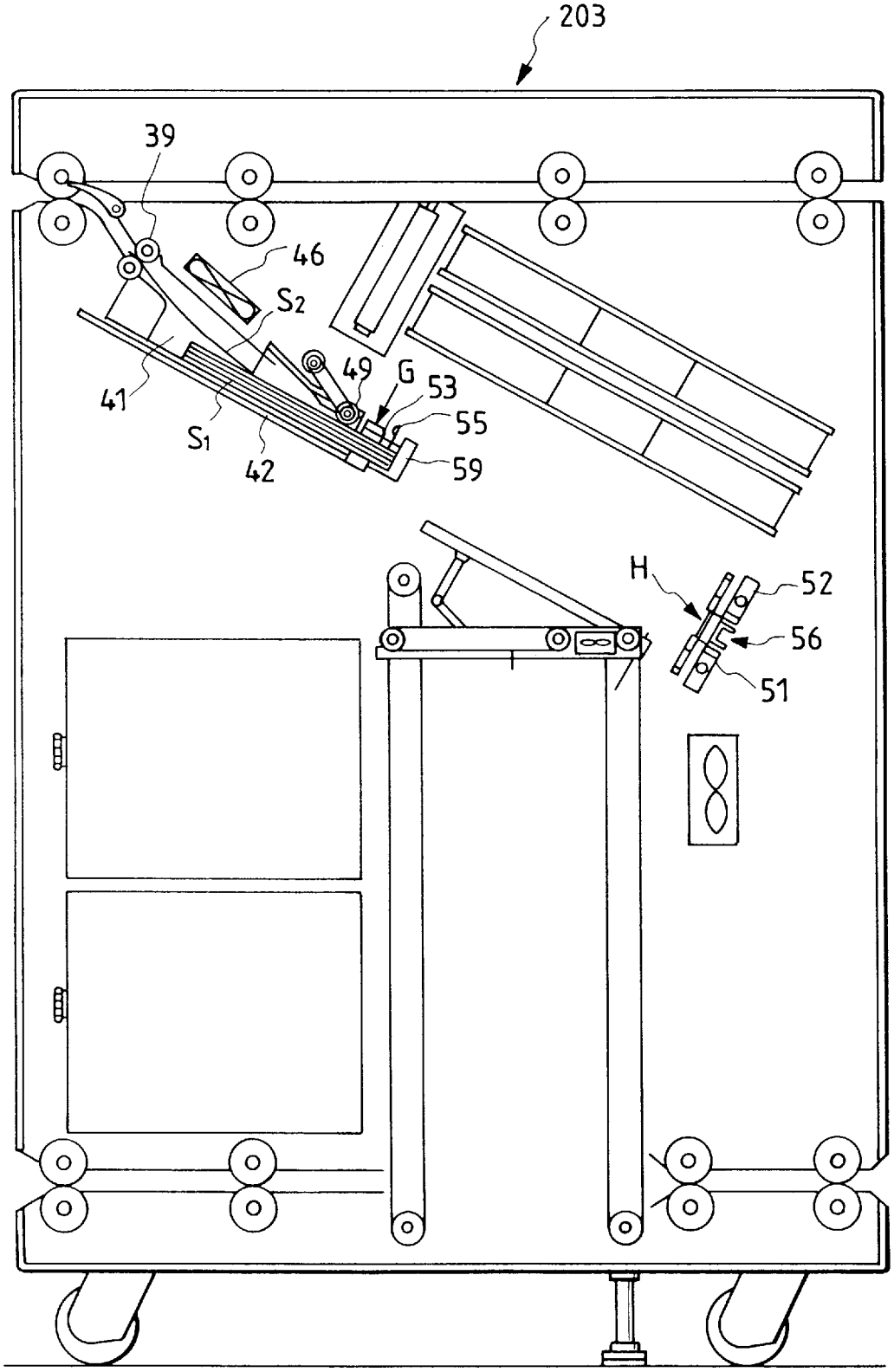
FIG. 6 is an elevational sectional view for explaining an operation for aligning sheets on an align tray of the book-binding apparatus.

In FIG. 6, when the sheets for forming the sheet bundle S1 are introduced into the sheet align tray 41, the clamp member 53 is operated toward a direction C to clamp the sheet bundle S1. In this case, when plural parts of book-bound articles are desired, at the same time, the stop finger 55 is operated to temporarily store several sheets S2 for a next sheet bundle until the sheet bundle S1 aligned and clamped by the clamp member 53 is fed out from the align tray 41.

Figure 7:
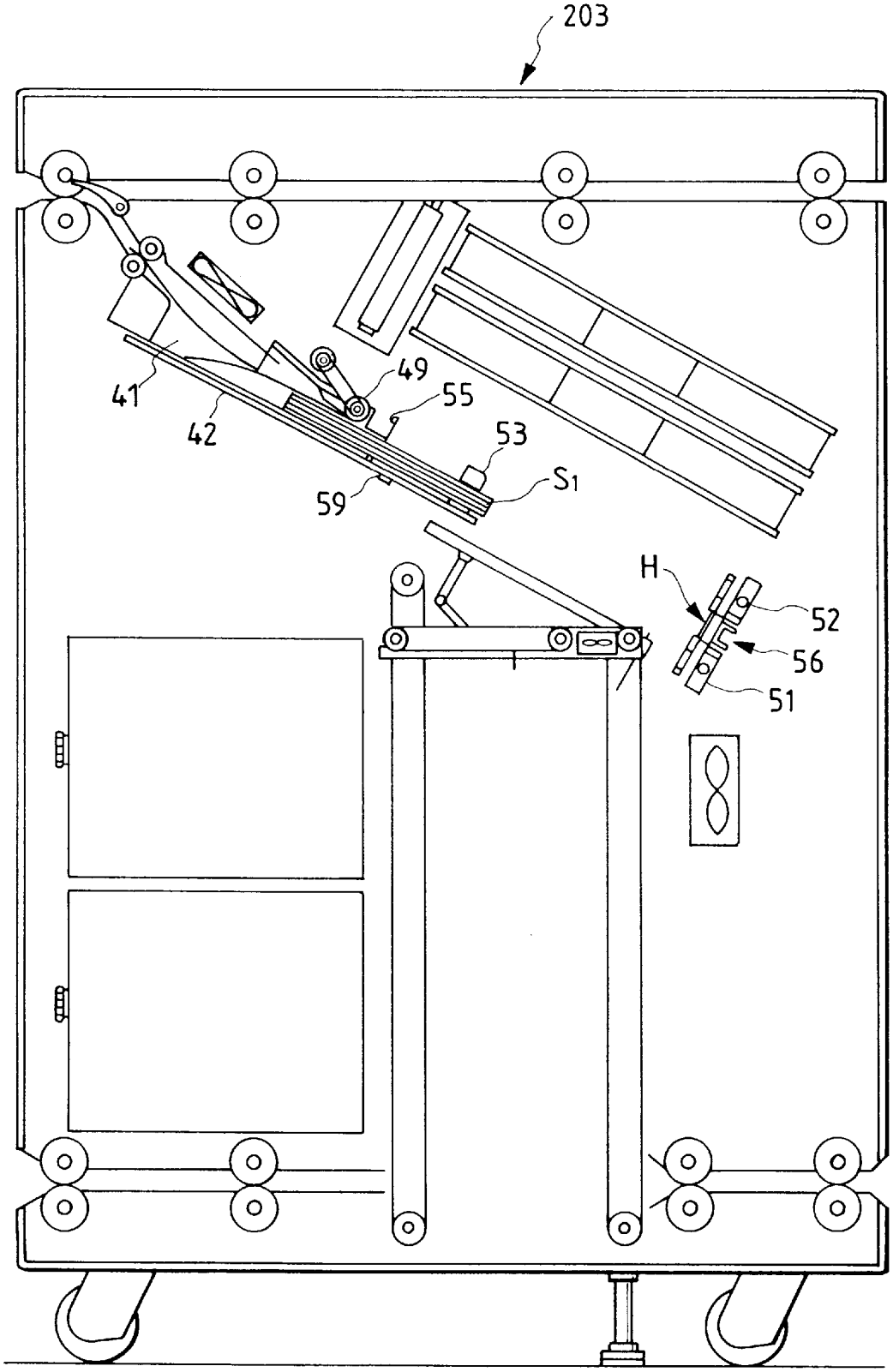
FIGS. 7 to 9 are elevational sectional views for explaining an operation for shifting a sheet bundle aligned on the align tray to a back surface of a heater.

FIG. 7 shows a condition that the abutment member 59 is retracted to the retract position and the sheet bundle S1 is shifted to the back surface abutment position H by the clamp member 53. The clamp member 53 clamps the sheet bundle S1 and moves straightly toward the back surface abutment position H without affecting excessive stress on the sheet bundle S1. In this case, substantially in synchronism with the shifting movement of the clamp member 53, the auxiliary guide plate 42 is shifted substantially at the same speed in parallel with the sheet bundle S1 from the align tray 41 to the vicinity of the back surface abutment position H, thereby guiding the lower surface of the sheet bundle S1.

Figure 8:
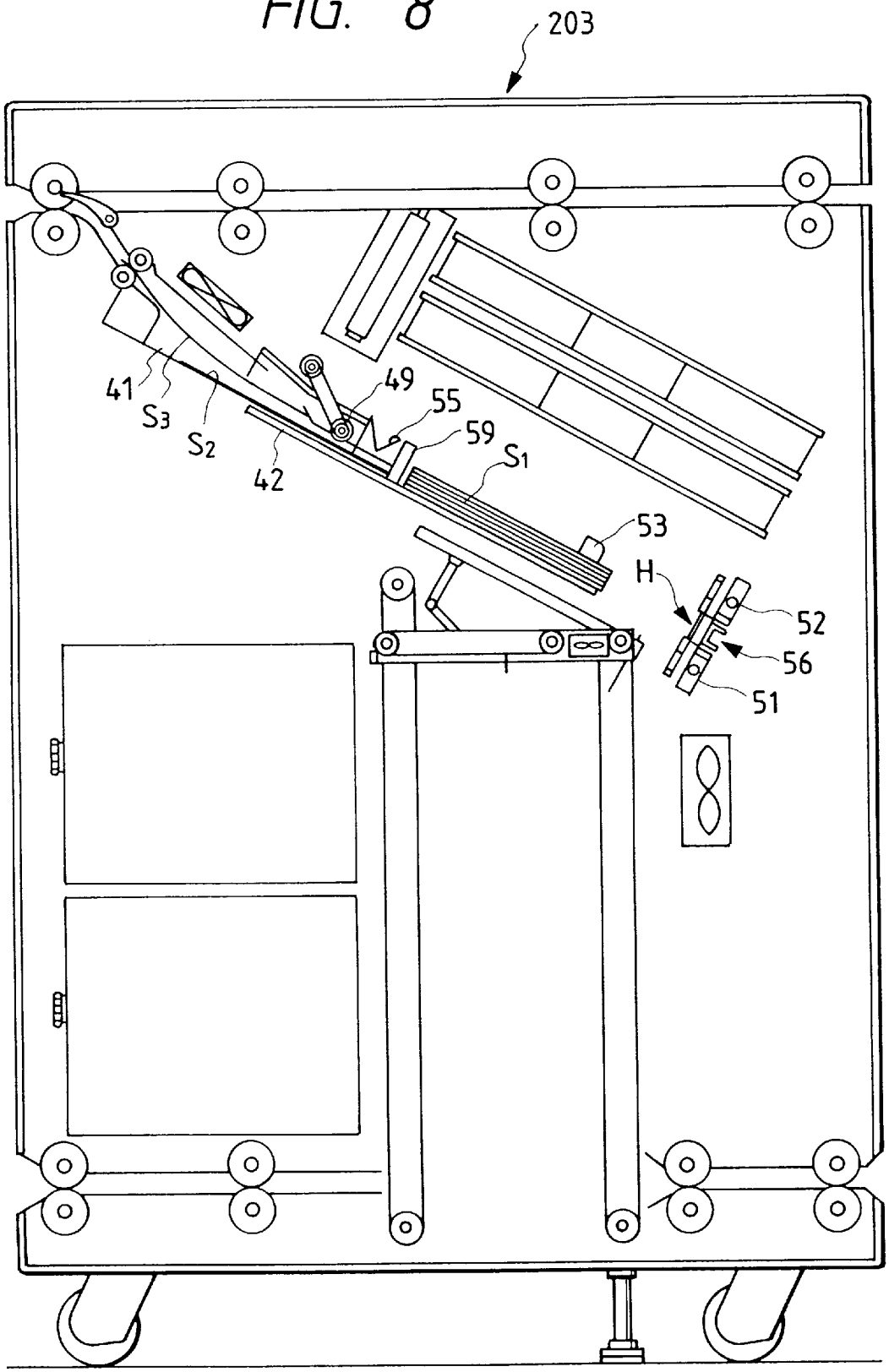

FIG. 8 shows a condition that the sheet bundle S1 is conveyed out of the align tray 41 by the clamp member 53. When the sheet bundle S1 is conveyed out of the align tray 41 by the clamp member 53, the abutment member 59 is returned to the abutment position and the stop finger 55 is shifted from the storing position to the retract position, with the result that the stored several sheets S2 are rested on the align tray 41 and the subsequent sheets S3 are aligned on the align tray 41.

Figure 9:
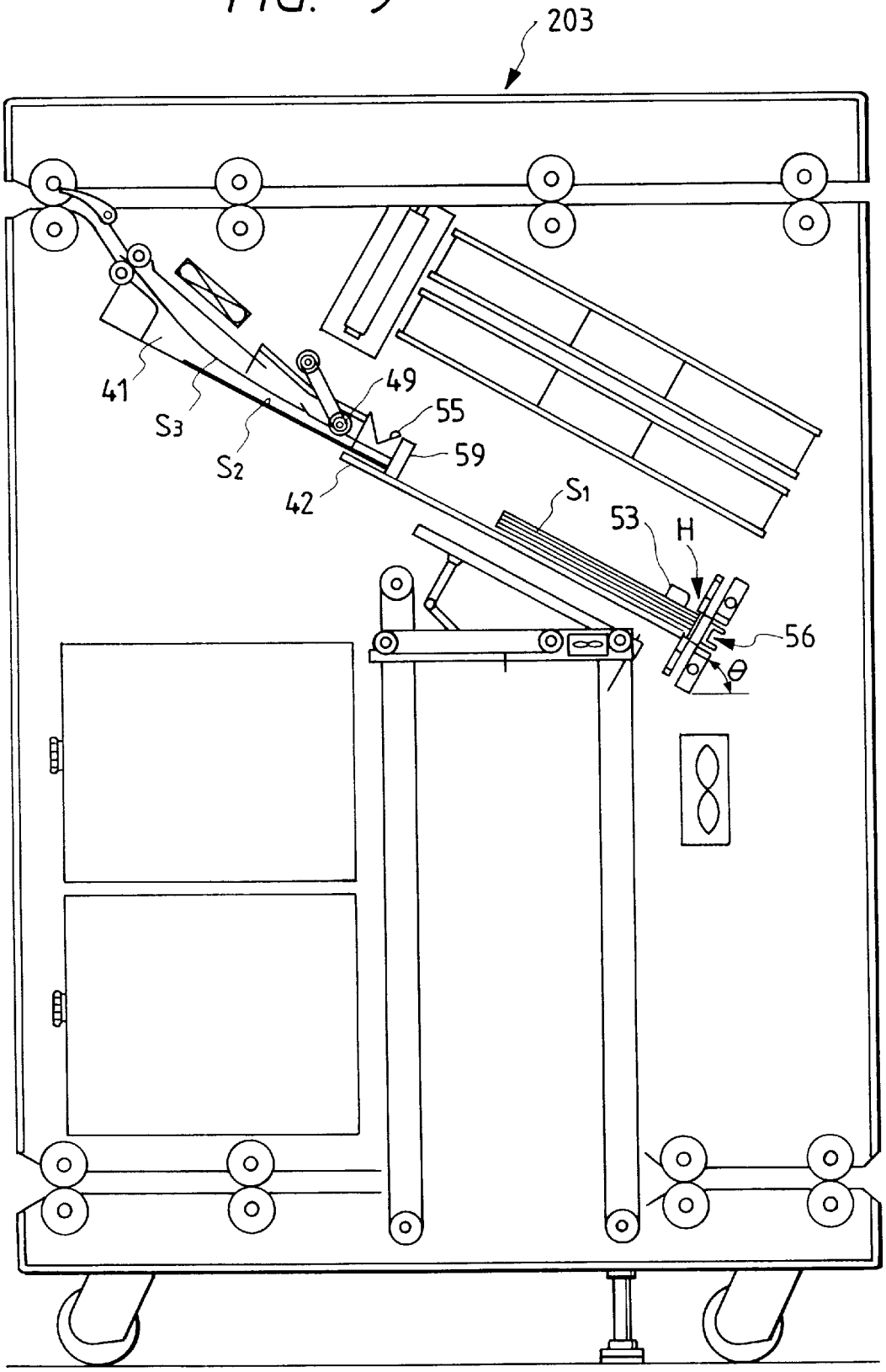

FIG. 9 shows a condition that the tip end of the sheet bundle S1 clamped by the clamp member 53 is urged against a heater surface of the tape heating device 56 positioned at the back surface abutment position H. In this case, as mentioned above, the sheet bundle S1 is clamped by the clamp member 53 and is straightly moved while being guided by the auxiliary guide plate 42 at its lower surface. Incidentally, a distance between the abutment member 59 and the back surface abutment position H is greater than the length of the sheet bundle S1 to be book-bound.

Figure 10:
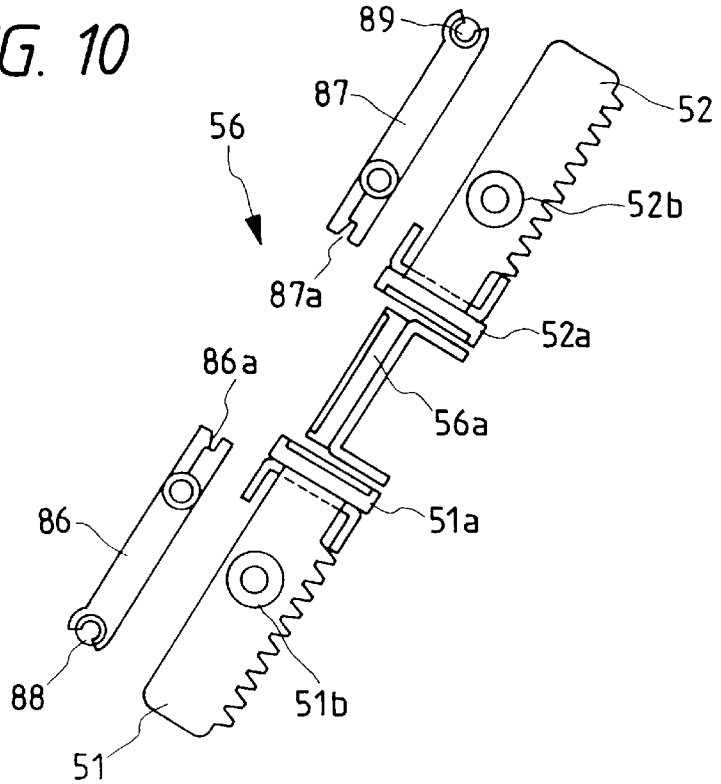
FIG. 10 is an elevational sectional view of a heater portion of the book-binding apparatus.

FIG. 10 shows a detailed construction of the tape heating device 56.

In FIG. 10, the tape heating device 56 has a back surface heater 56*a* for heating the bind tape 77. Side heaters 51, 52 disposed on both sides of the back surface heater 56*a* are provided at their inner sides with heaters 51*a*, 52*a* and at their sides with rollers 51*b*, 52*b*. In the vicinity of the side heaters 51, 52, there are provided tape guides 86, 87 having guide portions 86*a*, 87*a* at their inner ends. The tape guides can be rocked around support shafts 88, 89, respectively.

Figure 11:
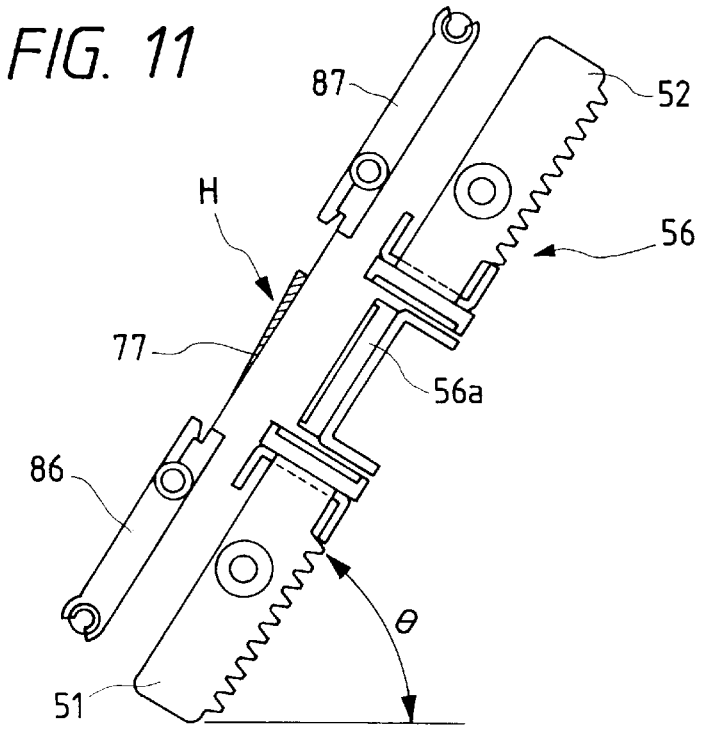
FIG. 11 is an elevational sectional view showing a condition that the bind tape is set at the heater portion.
Figure 12:
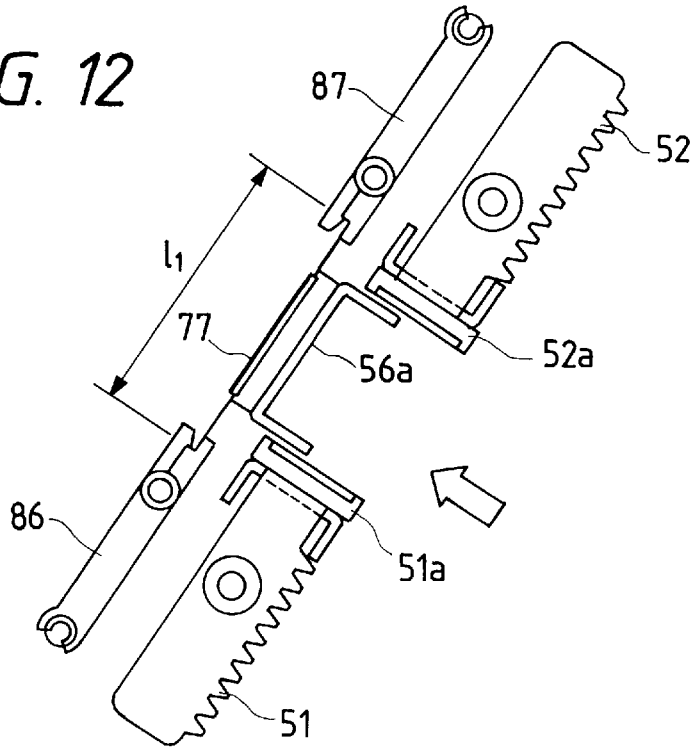
FIG. 12 is an elevational sectional view showing a condition that a back surface heater of the heater portion shifted to a back surface of the bind tape starts a heating operation.

FIGS. 11 to 20 show an operating condition of the tape heating device 56. FIG. 11 shows a condition that the bind tape conveyed by the pair of convey rollers 85 is supplied to the back surface abutment position H while being guided by the tape guides 86, 87. When the bind tape 77 is supplied to the back surface abutment position H, as shown in FIG. 12, the back surface heater 56*a* is shifted toward the tape 77 to start the heating of the bind tape 77.

Figure 13:
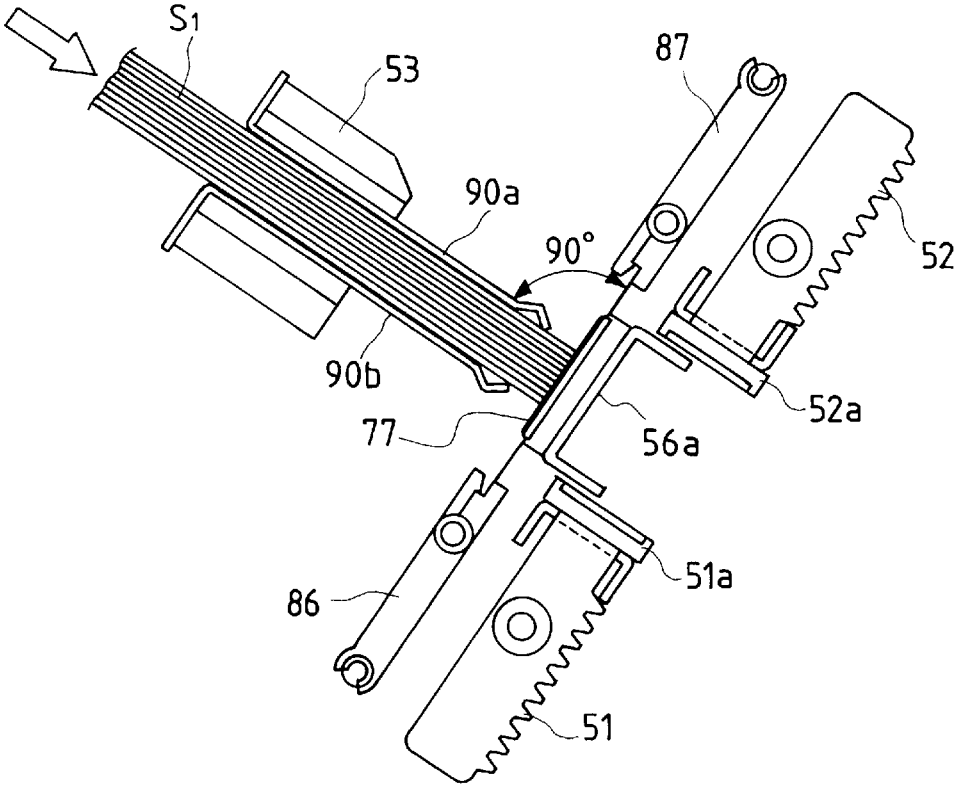
FIG. 13 is an elevational sectional view showing a condition that the sheet bundle is urged against the heated bind tape.

FIG. 13 shows a condition that the aligned sheet bundle S1 is shifted from the align tray to the back surface abutment position H by the clamp member 53 and the tip end (back surface) of the sheet bundle S1 is urged against an adhesive surface of the bind tape 77. In this case, the upper and lower surfaces of the sheet bundle S1 are guided by upper and lower regulating guides 90*a*, 90*b*. The reason is that the swelling of the sheet bundle due to curls in the sheets, weights of the sheets and/or heat from the tape heating device 56. Further, since there is certain time lag until the heaters reach their optimum temperatures from the initiation of energization, when the entire system is turned ON, the heating and temperature adjustment are started. During the operation, the control is effected to always maintain the temperature constant.

Figure 14:
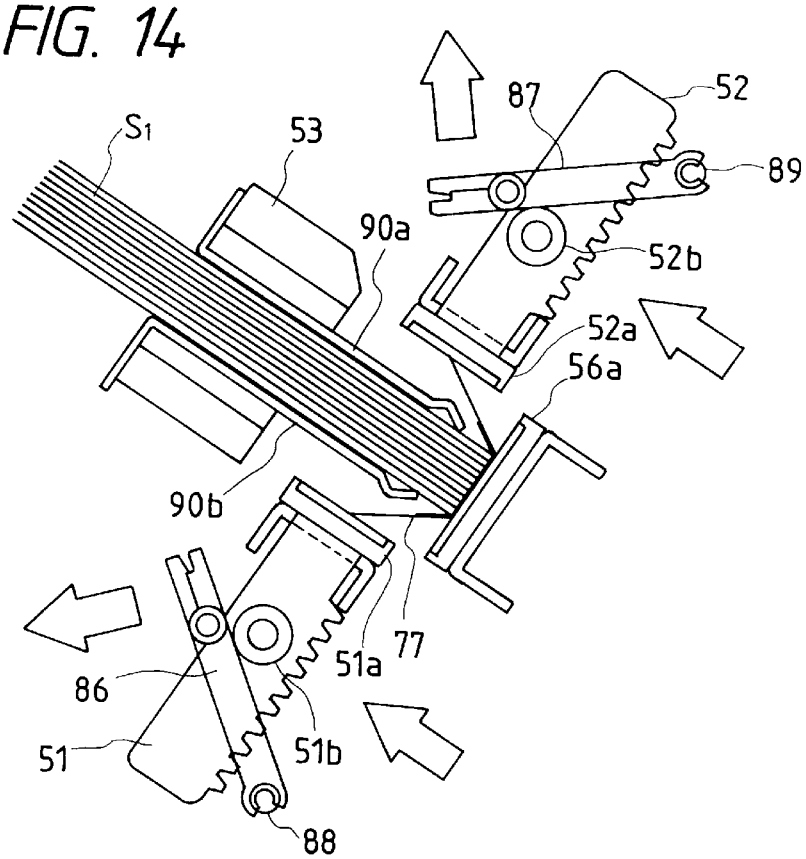
FIGS. 14 and 15 are elevational sectional views for explaining an operation for effecting that the binding by means of side heaters of the heater portion.
Figure 15:
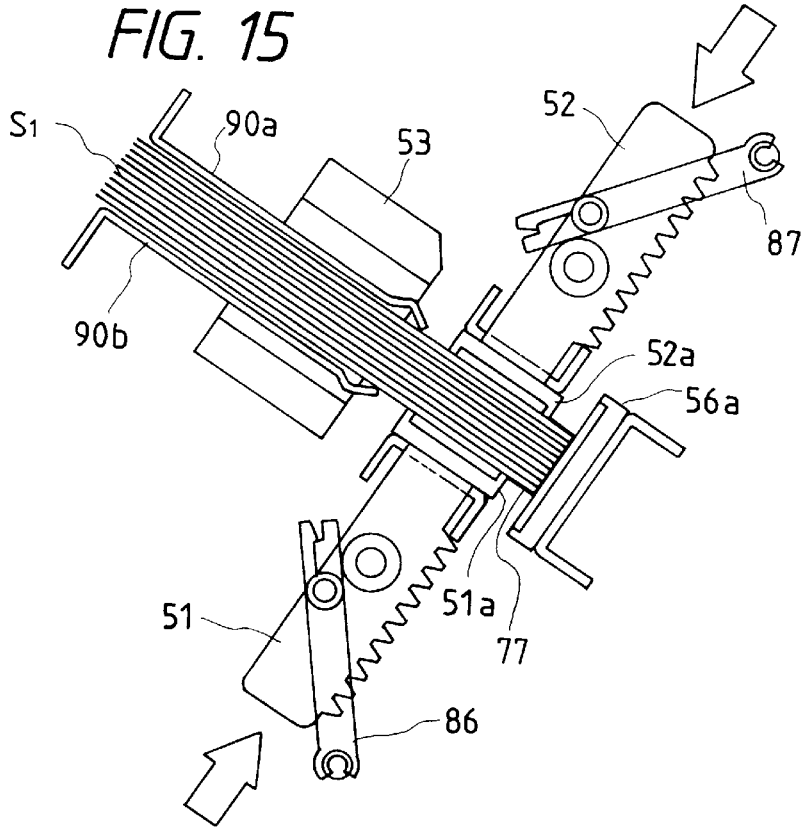

After the bind tape is adhered to the back surface of the sheet bundle, as shown in FIG. 14, the side heaters 51, 52 are shifted along the sheet bundle to pull the both ends of the bind tape 77 toward the sheet bundle while retarding the tape guides 86, 87 by the rollers 51*b*, 52*b*, thereby starting the side binding of the sheet bundle S1. In this case, as shown in FIG. 15, the upper and lower tape guides 86, 87 are retracted rearwardly from the tip end of the sheet bundle as the side heaters 51, 52 are shifted. Then, the side heaters 51, 52 urge the bind tape against the upper and lower surfaces of the sheet bundle S1, thereby effecting the side binding.

Figure 16:
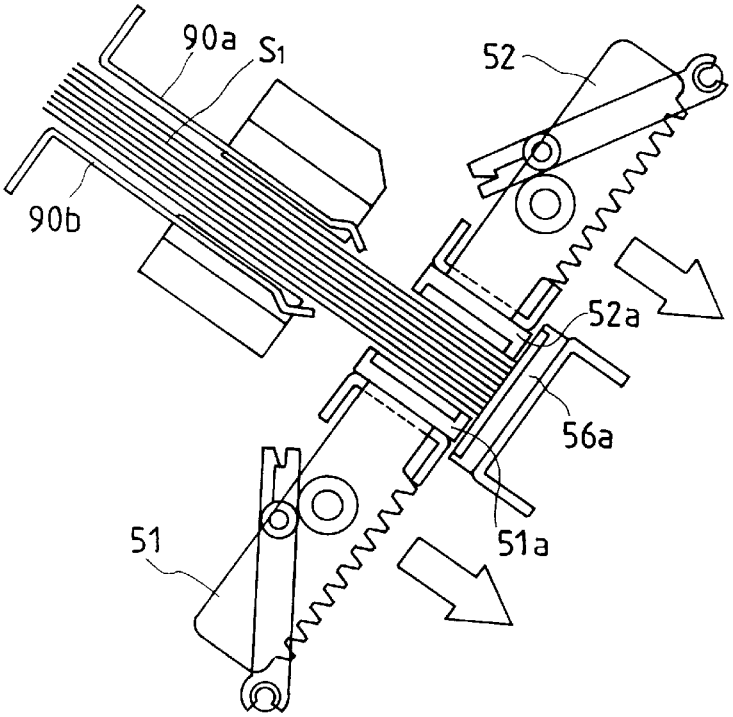
FIGS. 16 and 17 are elevational sectional views for explaining an operation of the heater portion after the book-binding is finished.

When the side binding of the sheet bundle S1 is finished, in order to finish the bent portions of the bind tape (side binding), as shown in FIG. 16, the side heaters 51, 52 are shifted in directions shown by the arrows while applying pressure the sheet bundle.

Figure 17:
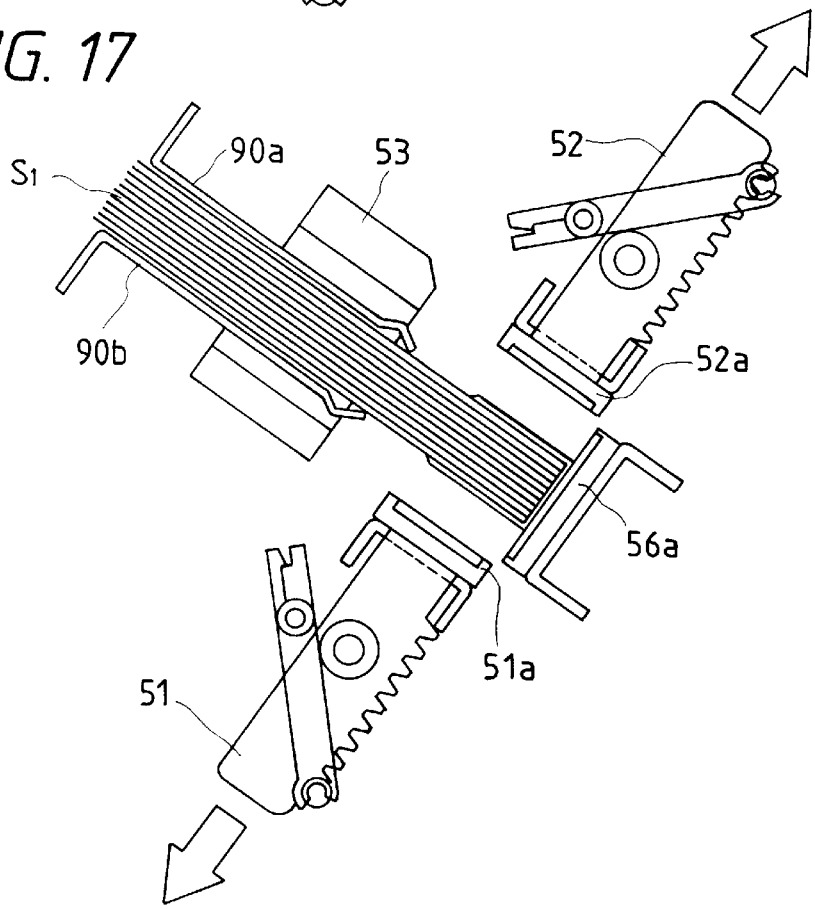
Figure 18:
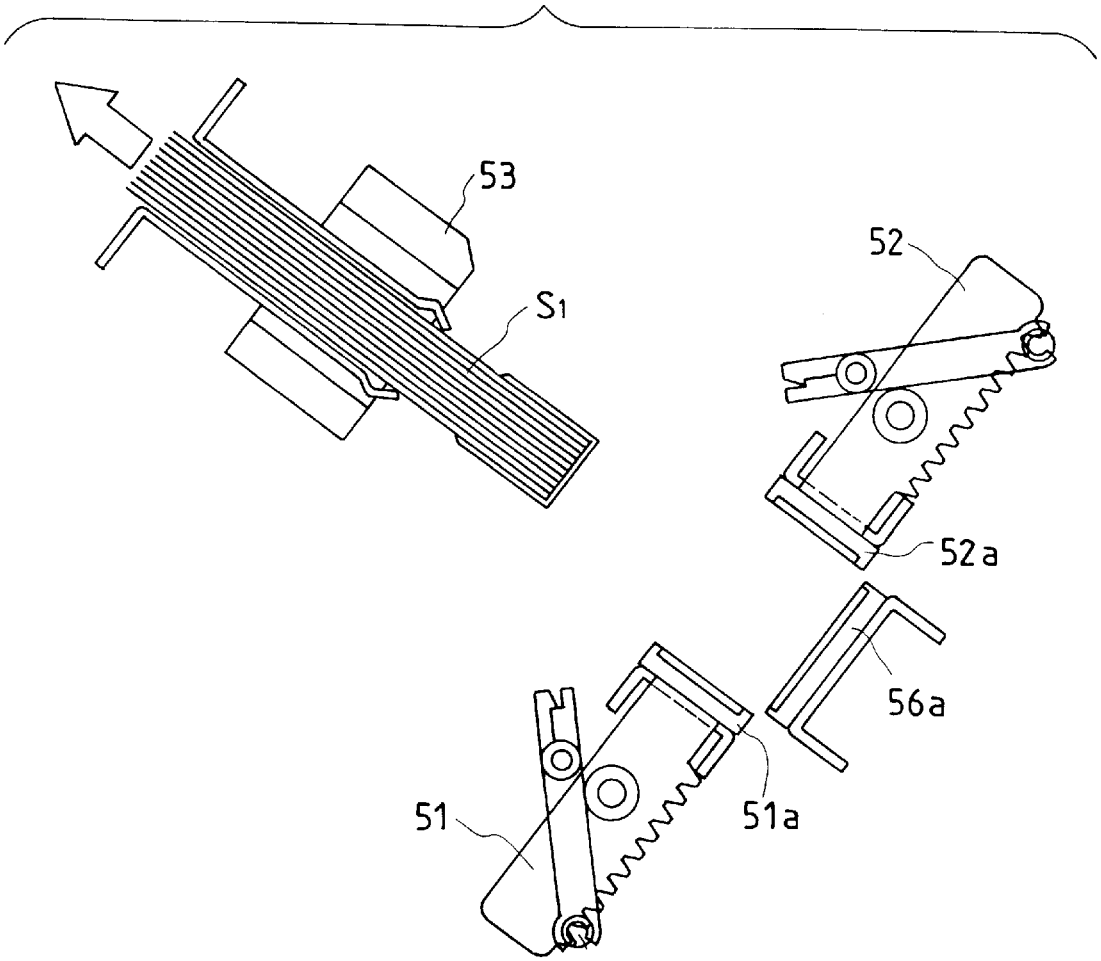
FIGS. 18 to 20 are elevational sectional views for explaining the operation of the heater portion and a sheet bundle retracting operation after the book-binding is finished.

Then, the side heaters 51, 52 are shifted to directions shown by the arrows as shown in FIG. 17, thereby releasing the pressure of the side heaters 51, 52. When the pressure of the side heaters 51, 52 is released, as shown in FIG. 18, the book-bound article (sheet bundle) S1 is retracted from the back surface abutment position H by the clamp member 53, and, as shown in FIG. 19, the book-bound article S1 is sent to a transfer position (FIG. 21) to the carriage 60.

Figure 19:
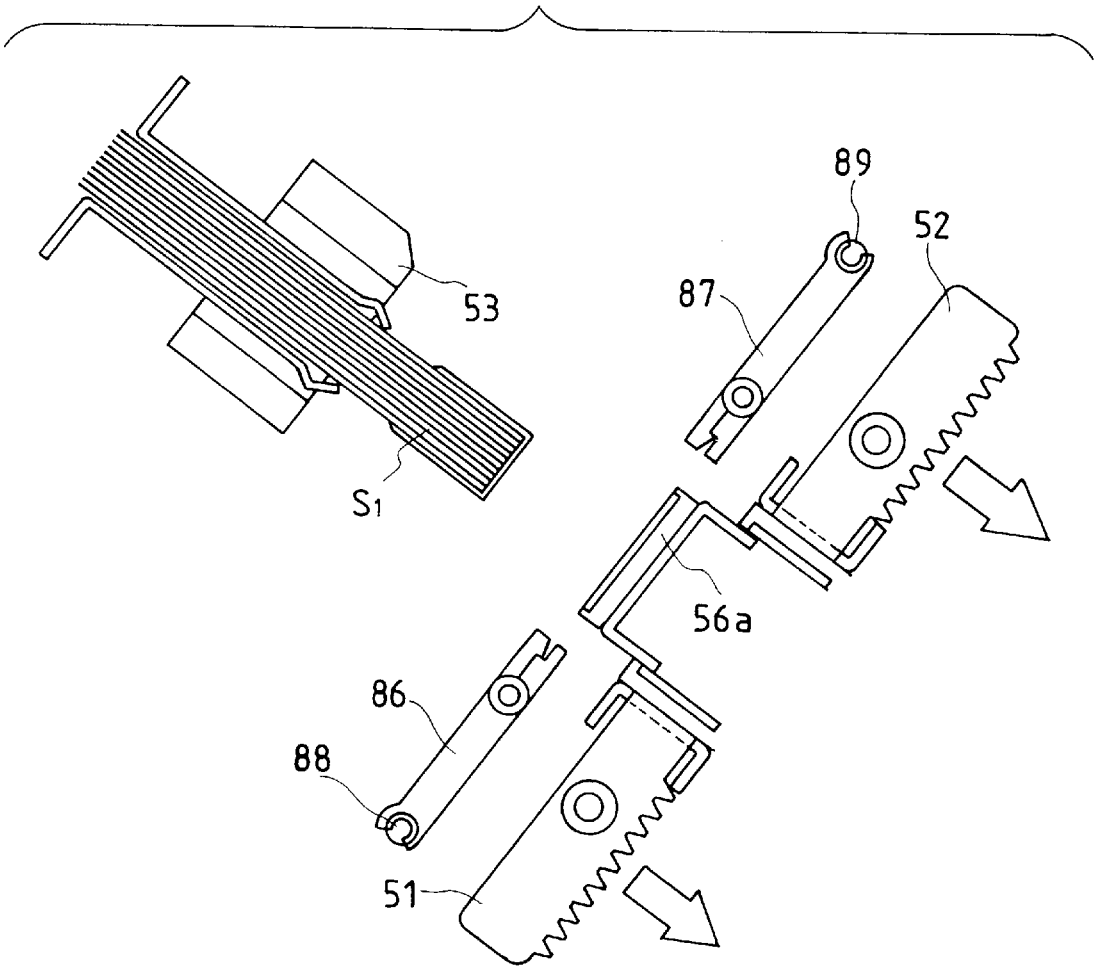
Figure 20:
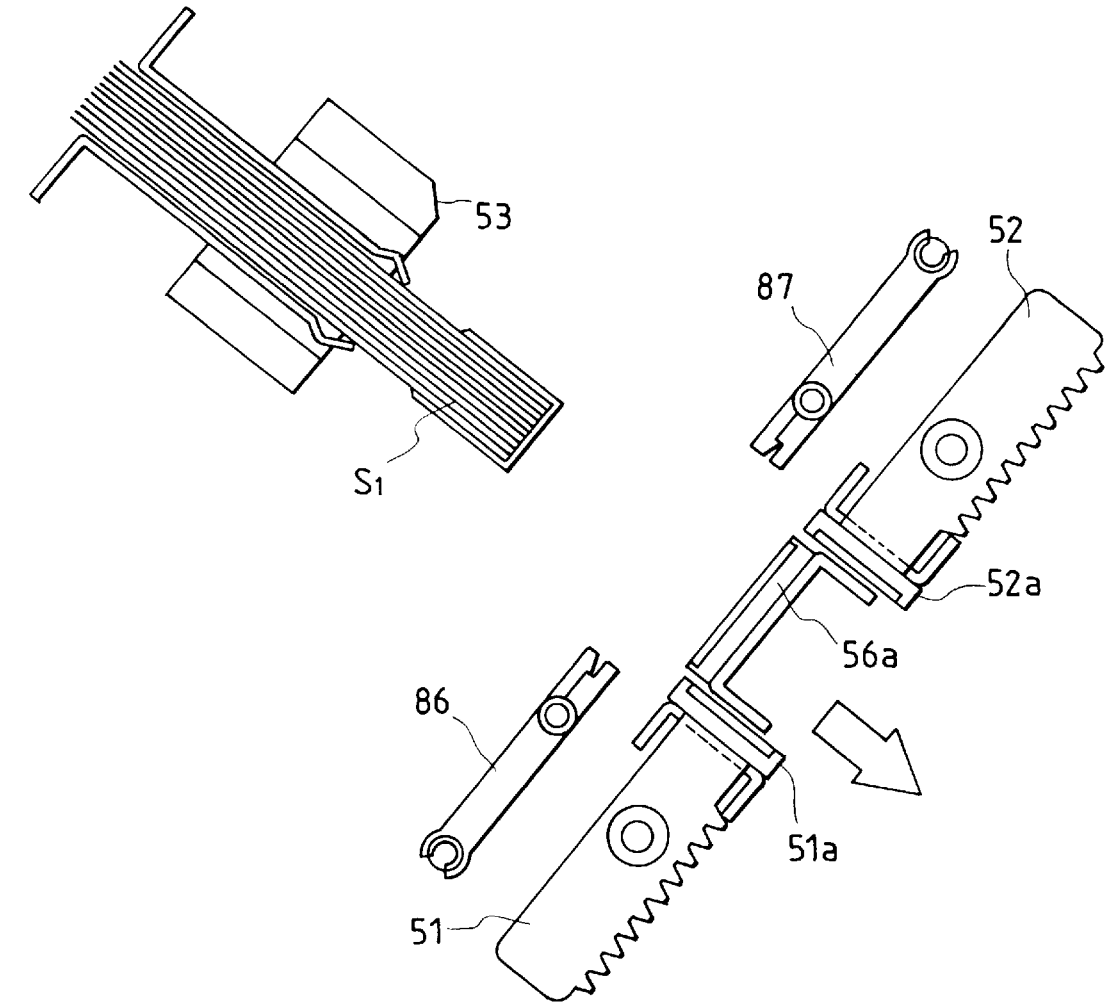
Figure 21:
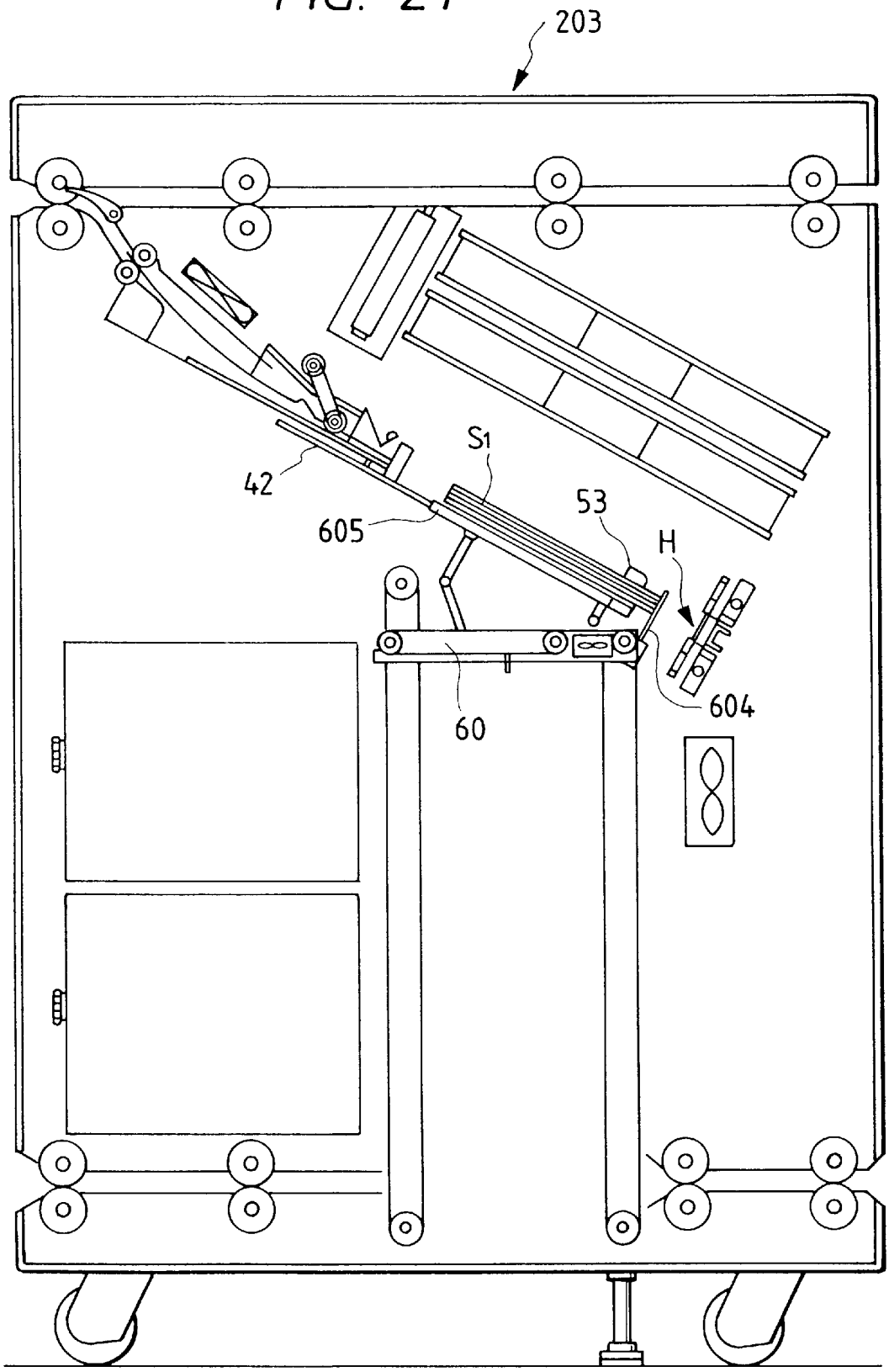
FIGS. 21 to 23 are elevational sectional views for explaining an operation for transferring a book-bound sheet bundle to a carriage.

When the book-bound article S1 is retracted from the back surface abutment position H, as shown in FIGS. 19 and 20, the side heaters 51, 52 and the back surface heater 56*a* are returned to their retract positions for the next bind tape 77. FIG. 21 shows a condition that the book-bound article S1 is shifted to the transfer position (to the carriage 60) while being guided by the auxiliary guide plate 42 at it lower surface.

While the sheet bundle S1 is being book-bound at the back surface abutment position H, the sheet bundle supporting rod 605 of the carriage 60 is shifted in a direction D (FIG. 2) to support the lower surface of the sheet bundle S1 together with the auxiliary guide plate 42. When the book-bound sheet bundle S1 is separated from the back surface heater 56*a* by the clamp member 53, the sheet bundle trail end supporting plate 604 is rotated to enter between the lifted tip end portion of the sheet bundle S1 and the back surface heater 56*a*. Incidentally, the auxiliary guide plate 42 and the sheet bundle supporting rod 605 have comb shapes to enter into each other.

Figure 22:
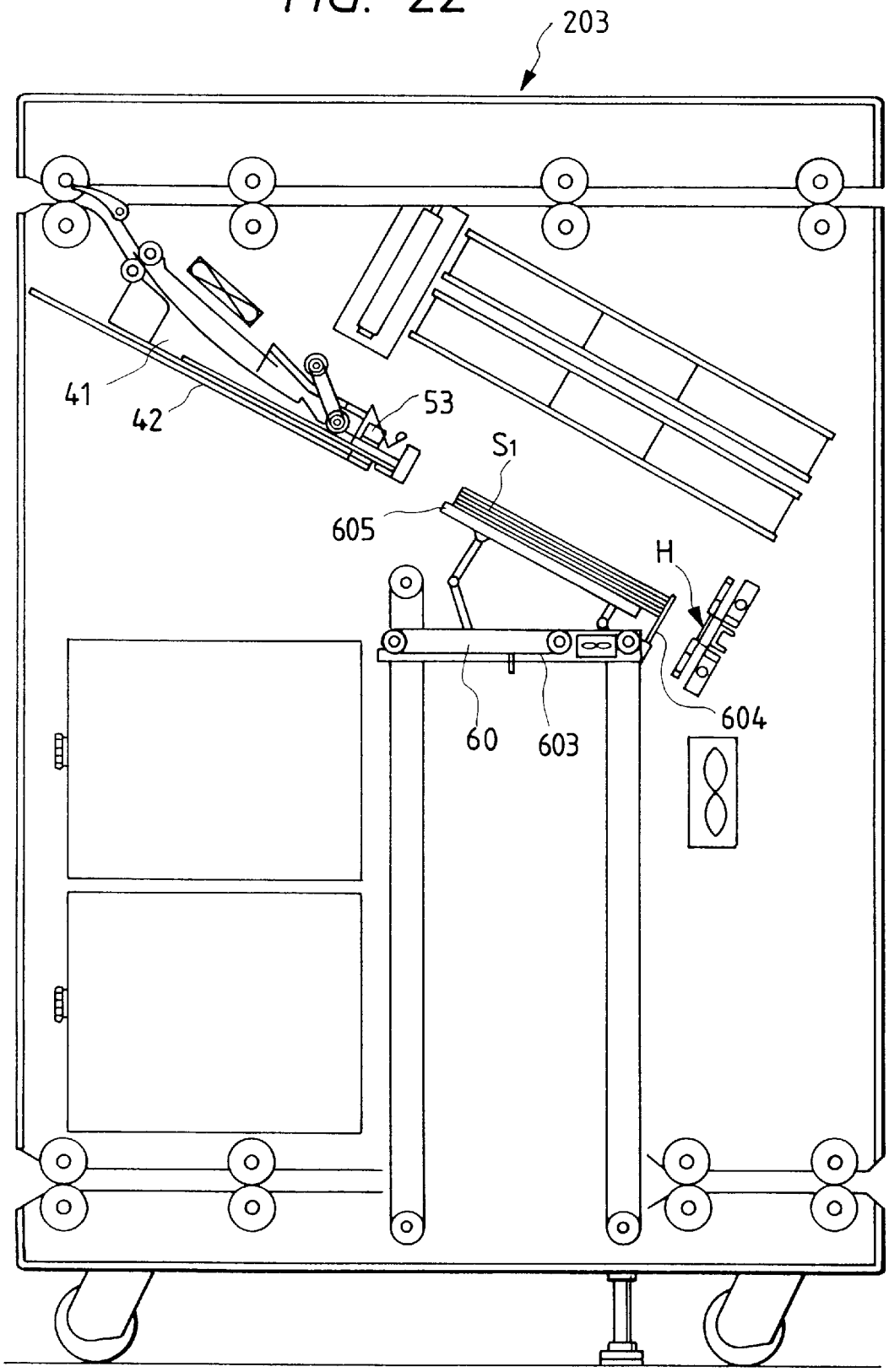

FIG. 22 shows a condition that the clamp member 53 and the auxiliary guide plate 42 are returned to their initial positions regarding the align tray 41 and the tip end of the sheet bundle S1 abuts against so as to be supported by the sheet bundle supporting rod 605, i.e., a condition that the sheet bundle S1 is transferred to the carriage 60. In this case, since the sheet bundle S1 is lifted by the sheet bundle supporting rod 605 above a moving track of the auxiliary guide plate 42, the clamp member 53 and the auxiliary guide plate 42 do not contact with the lower surface of the sheet bundle S1, with the result that the clamp member 53 and the auxiliary guide plate 42 can be returned to the align tray 41.

Figure 23:
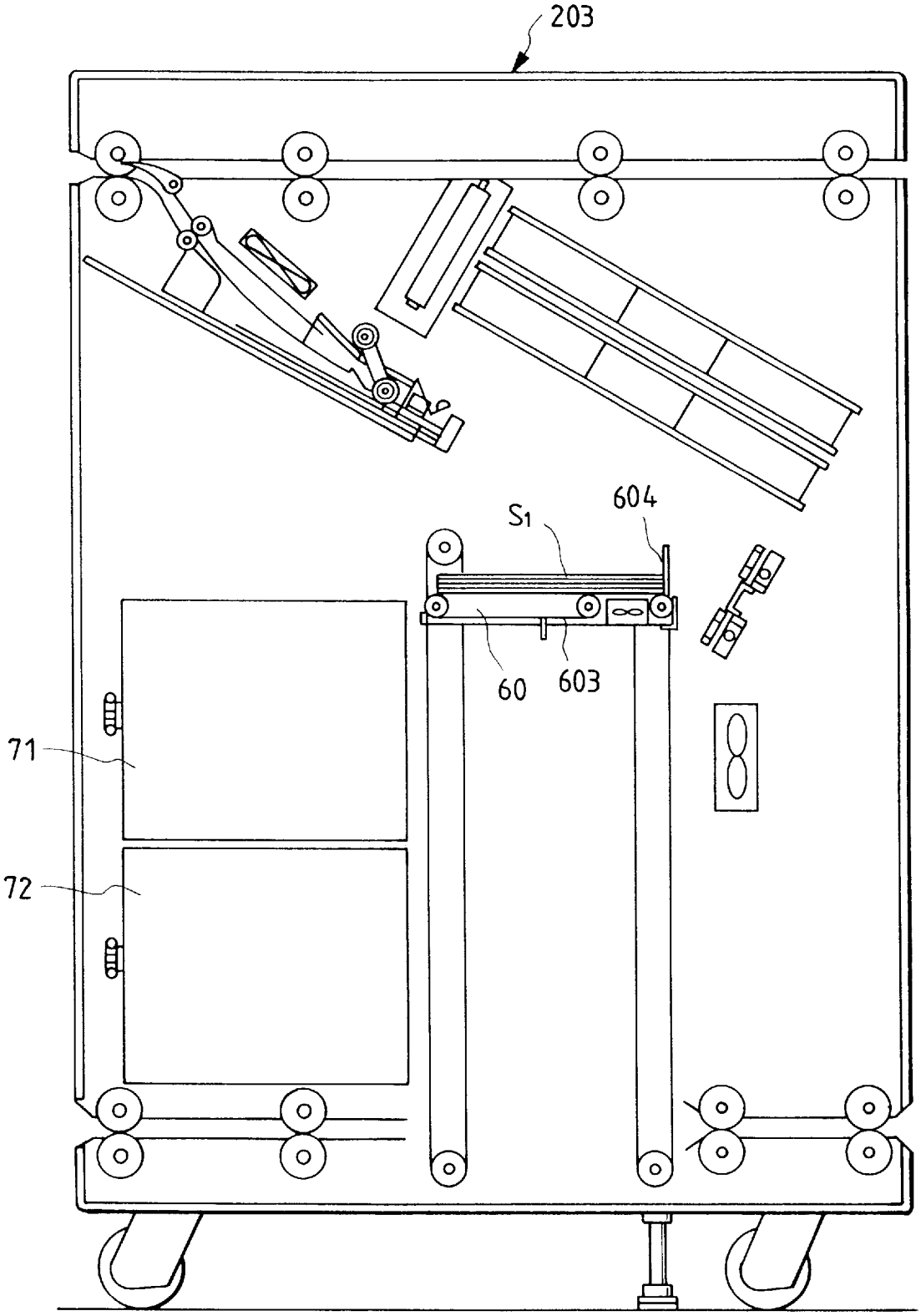
Figure 24:
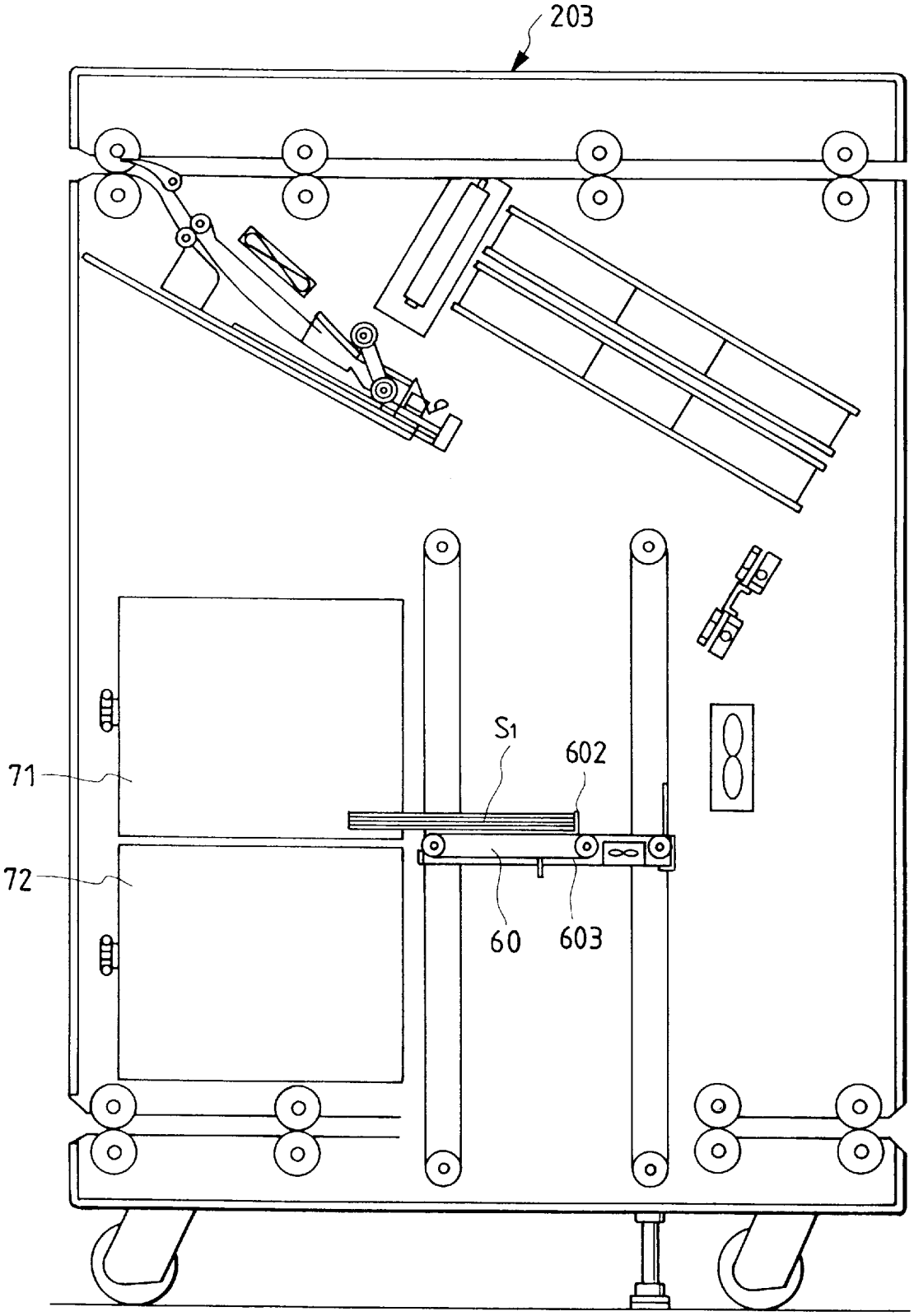
FIG. 24 is an elevational sectional view showing a condition that the book-bound sheet bundle is received into an upper stacker by the carriage.
Figure 25:
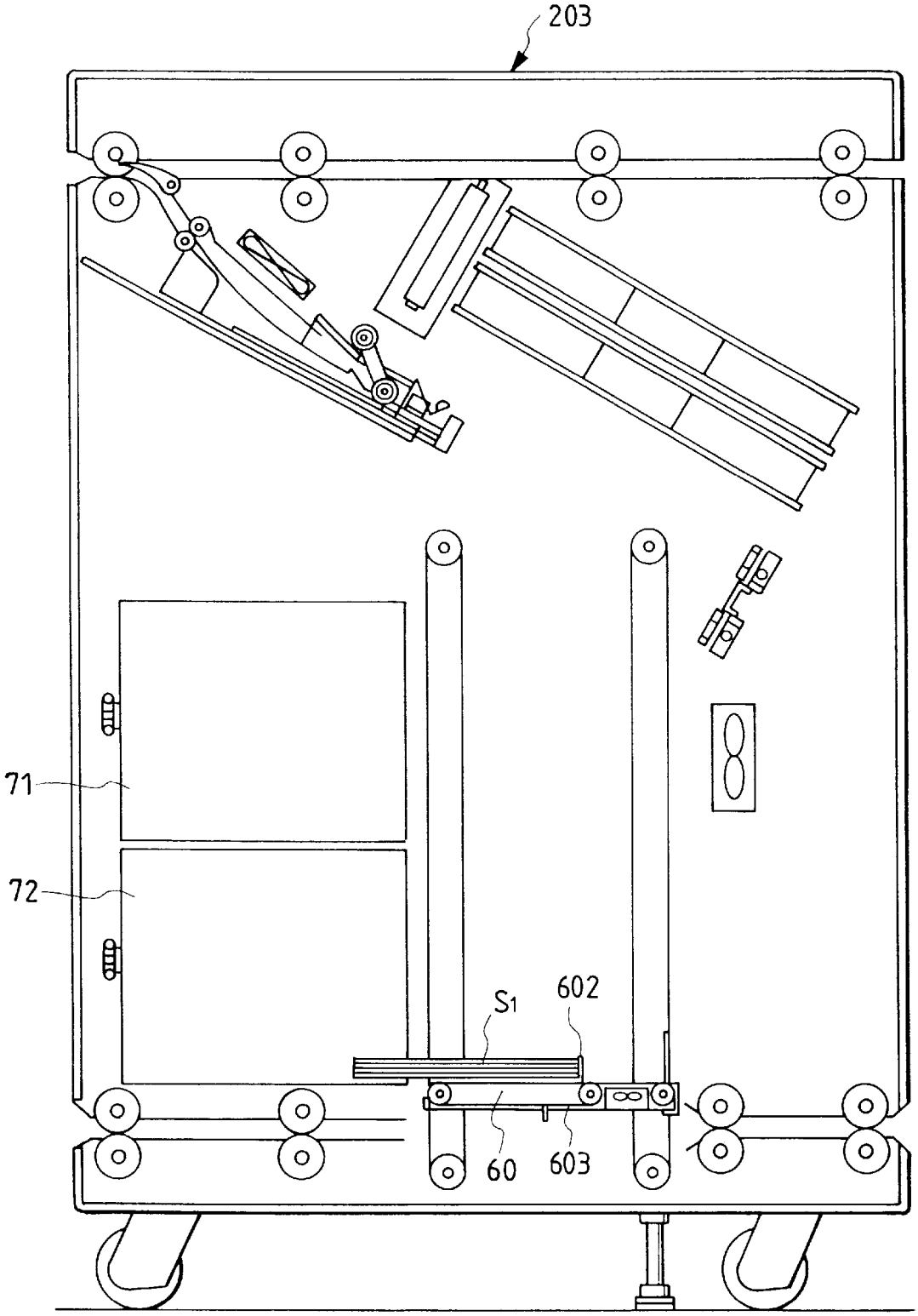
FIG. 25 is an elevational sectional view showing a condition that the book-bound sheet bundle is received into a lower stacker by the carriage.

After the clamp member 53 and the auxiliary guide plate 42 are returned to the align tray 41, the sheet bundle supporting rod 605 and the sheet bundle trail end supporting plate 604 are rotated in a direction E (FIG. 2), thereby maintaining the sheet bundle S1 in a horizontal condition as shown in FIG. 23. In this horizontal condition, the sheet bundle S1 is rested on the convey belt 603. FIG. 24 shows a condition that the book-bound article S1 contained in the stacker 71 and FIG. 25 shows a condition that the book-bound article is contained in the stacker 72. The book-bound article S1 on the carriage 60 is contained into the stacker 71 or 72 by the convey belt 603 and the pushing member 602.

Figure 26:
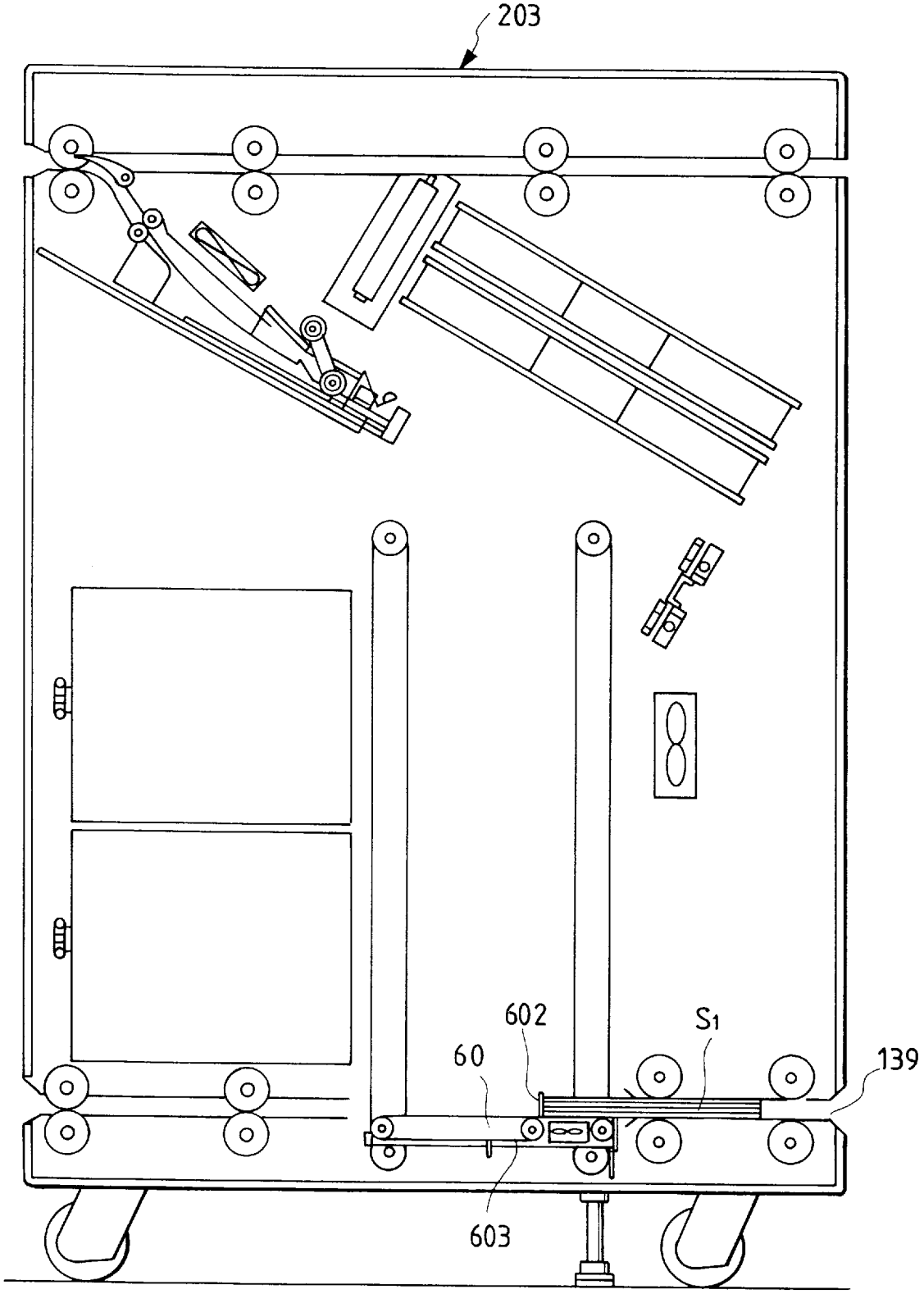
FIG. 26 is an elevational sectional view showing a condition that the book-bound sheet bundle conveyed by the carriage is being discharged out of the book-binding apparatus.
Figure 27:
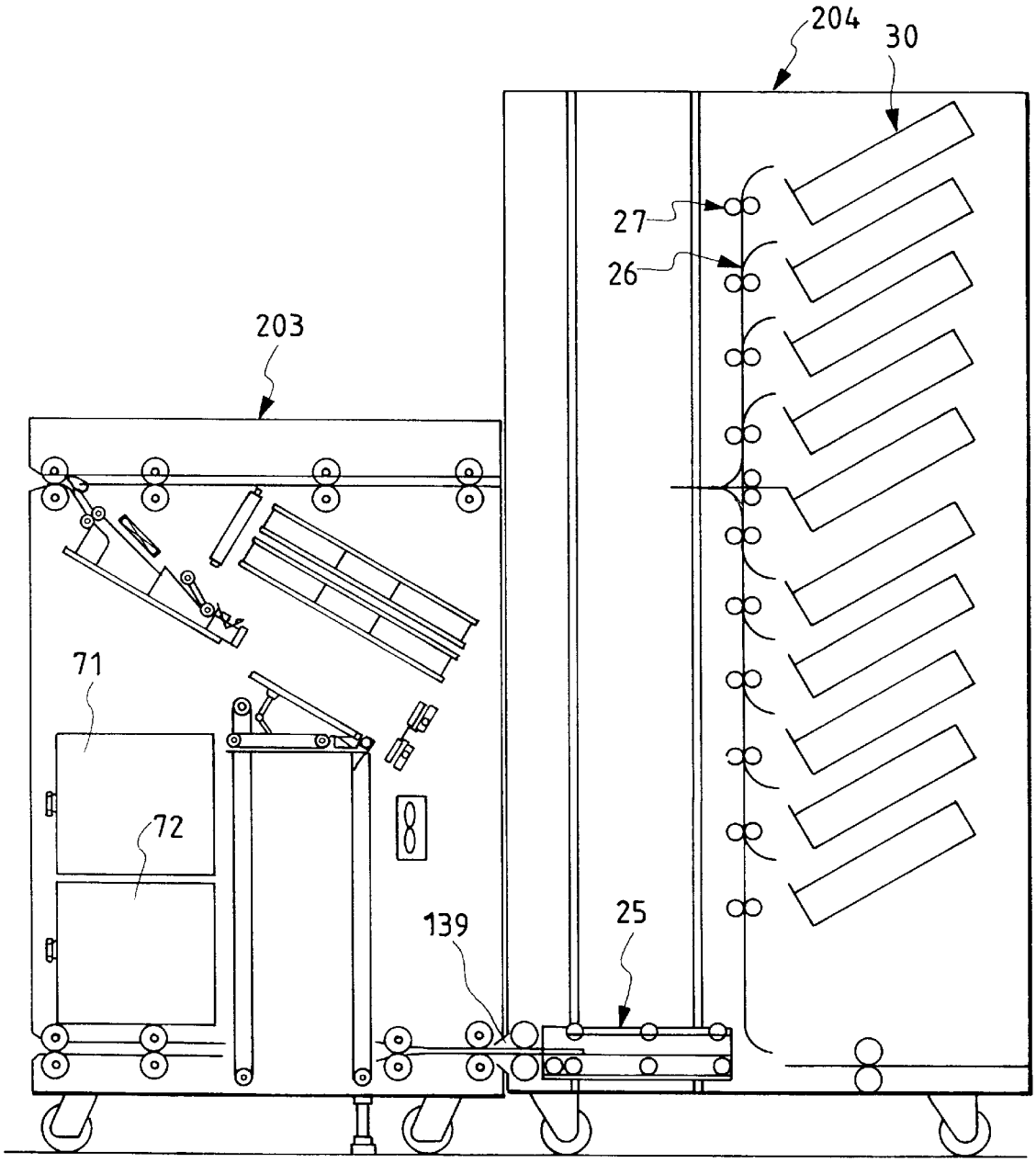
FIG. 27 is an elevational sectional view showing a condition that the book-bound sheet bundle discharged from the book-binding apparatus is transferred to an elevator of a sorting and containing apparatus.

When the book-bound article S1 on the carriage 60 is not contained into the stacker 71 or 72, as shown in FIG. 26, the book-bound article S1 is discharged out of the book-binding apparatus through the second discharge opening 139. As shown in FIG. 27, the book-bound article S1 is discharged out of the book-binding apparatus through the second discharge opening 139 in this way is transferred to an elevator 25 at a lower portion of the sorting and containing apparatus 204. By lifting the elevator 25, the book-bound article is discharged and contained in a desired discharge tray 30. When the book-bound article S1 is not desired to be discharged in the discharge tray, the book-bound article is discharged out of the sorting and containing apparatus 204 through the elevator 25 positioned at the lowermost position.

When the non book-bound sheet bundle or the sheet is sent to the sorting and containing apparatus 204 through the book-binding apparatus 203, the carriage 60 positioned at the position shown in FIG. 2 is shifted downwardly. In this case, the non-book-bound sheet bundle or the sheet is enters into the entrance 91 below the stacker 72 and passes through the left lower convey path 92, carriage 60 and right lower convey path 93 and is discharged from the second discharge opening 139. With this arrangement, when the sheet bundle or the sheet is discharged out of the book-binding apparatus 203 in this way, since the sheet bundle or the sheet can be sent without passing through the convey path 26 of the sorting and containing apparatus 204, the sheet bundle can easily be discharged out of the system.

Next, the book-binding operation of the book-binding apparatus 203 will be explained with reference to FIG. 28.

A time period T0 shows a duration during which the sheets forming the sheet bundle are aligned with each other on the sheet align tray 41 by means of the abutment member 59 and the side regulating member 50. As mentioned above, when the alignment is finished, non-book-bound sheet bundle is bundle-conveyed to the tape heating device 56 by the clamp member 53. In this case, the aligning operation of sheets for the next sheet bundle is effected by using the stop finger 55. Accordingly, the timing chart regarding the sheet bundle alignment indicates that, after the alignment of one sheet bundle is finished, the alignment of next sheet bundle is continued. The aligned sheet bundle is conveyed immediately (sheet bundle conveyance).

Figure 28:
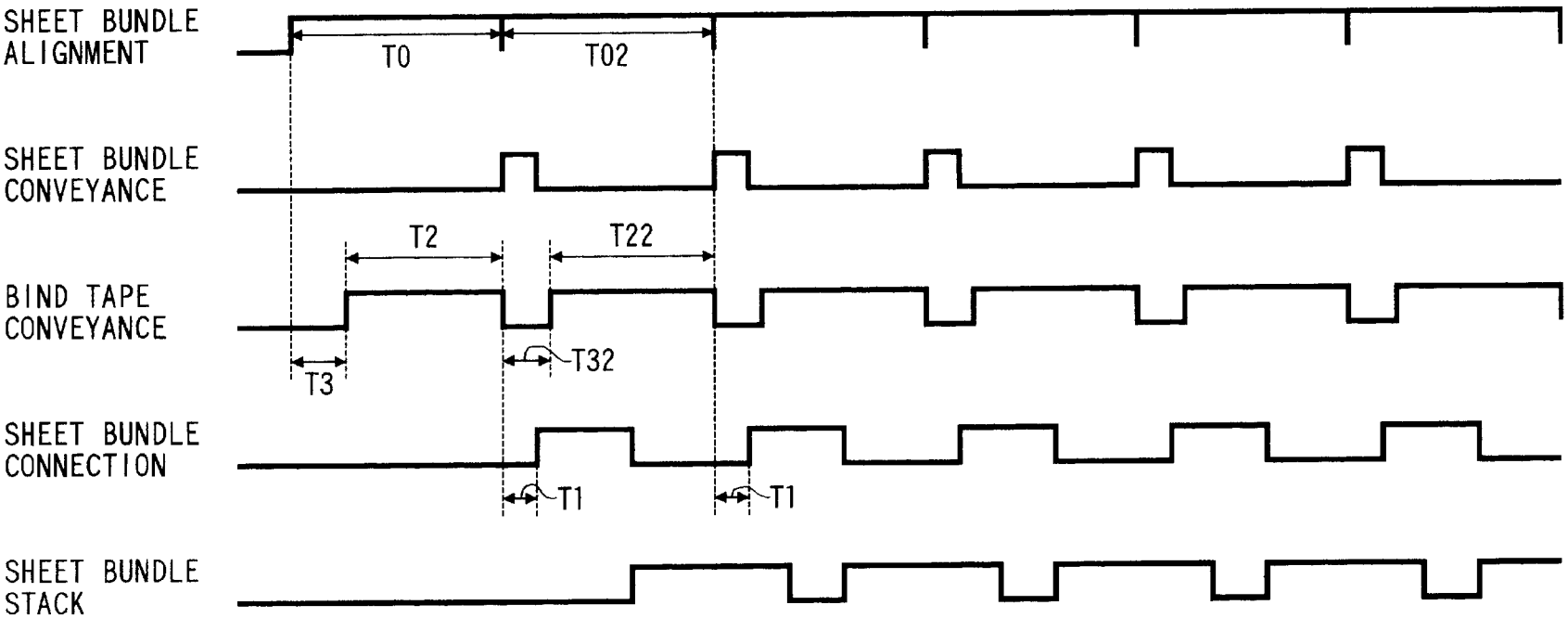
FIG. 28 is a timing chart for explaining a book-binding operation of the book-binding apparatus according to the present invention.

In bind tape conveyance shown in FIG. 28, the bind tape 77 supplied from the tape reel R1 (or R2) is conveyed, by the carriage C, to the tape heating device 56 positioned at the back surface abutment position. This conveyance requires a time period of T2. In sheet bundle connection, the sheet bundle is bound by the tape heating device 56.

During a time period T1 from when the bind tape conveyance is finished to when the sheet bundle connection is started, the bind tape is pre-heated. The time period T1 is required so that hot melt adhesive coated on the bind tape is melted to some extent before the sheet bundle is urged against the bind tape. If the hot melt adhesive is not melted before the sheet bundle is urged against the bind tape, since the adhesive cannot enter into between the sheets, after the sheet bundle is book-bound, the sheets can easily be dropped from the book-bound sheet bundle. The pre-heating time period T1 is also required in order to improve the quality of the book-binding. Further, the pre-heating time period T1 is a fixed time duration determined by material of the hot melt adhesive.

When the sheet bundle connection is finished, a sheet bundle stack treatment for transferring the book-bound sheet bundle to the stacker 71 or 72 is performed.

In order for the pre-heating time period T1 to elapse before the sheet bundle conveyance is completed, a time period T3 from when the sheet bundle alignment is started to when the bind tape conveyance is started (tape conveyance start timing) must be adjusted in consideration of the sheet bundle alignment time period T0. The time period T3 is calculated from the following equation (1):

$$T3=T0-T2 \quad (1)$$

Now, the bind tape conveyance time period T2 is determined by a shifting time period of the carriage C to the selected tape reel (R1 or R2) and a length of the bind tape 77 depending upon the size of the sheet bundle.

Further, the sheet bundle alignment time period T0 is a total time till all of the sheets are aligned with each other. The alignment time for each sheet is determined by the attribute (sheet size, conveying direction) of the sheet and post-treatment effected after the image formation. The time period T0 is calculated from the following equation (2):

$$T0=a0+a1+\ldots+an \quad (2)$$

Where, "ai" is a time period from when the alignment of (i−1)-th sheet is finished to when the alignment of i-th sheet is finished. When i=0, a0 indicates a time period from when the first sheet of the sheet bundle is conveyed to the sheet align tray 41 to when the alignment of the first sheet is finished. The time when the sheet is conveyed to the sheet align tray 41 can be measured by a sheet detection sensor (not shown) provided in the vicinity of the guide members 33, 34.

Next, a method for calculating and selecting "ai" in accordance with the attribute of the sheet will be explained.

Figure 29:
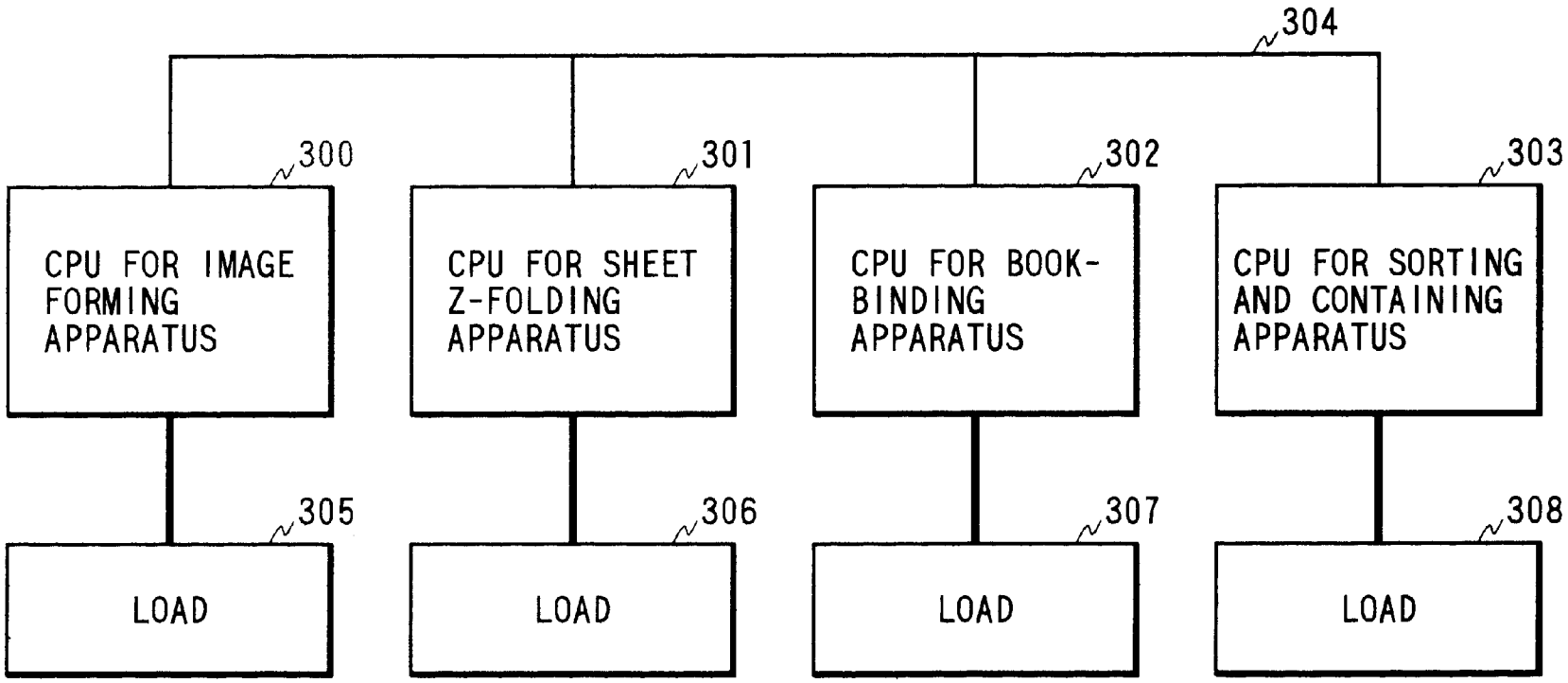
FIG. 29 is a block diagram of a control device for controlling the entire on-line system.

FIG. 29 shows a construction of a control device for controlling the entire on-line system. The image forming apparats 202, sheet Z-folding apparatus 205, book-binding apparatus 203 and sorting and containing apparatus 204 are provided with CPUs 300 to 303 for controlling the operations of the apparatuses and for effecting data communication and sheet transfer between the apparatuses. The CPUs 300 to 303 are connected to load portions (motor, sensor, clutch, solenoid etc.) 305 to 308 for controlling the apparatuses 202, 205, 203, 204. The reference numeral 304 denotes a communication line for effecting data communication and conveyance timing between the CPUs 300 to 303. Normally, the line is constituted by a serial communication line or a coaxial cable.

The control of the entire on-line system 1 is mainly effected by the CPU 300 of the image forming apparatus. The output mode commanded to the apparatus, i.e. content set by the operation portion 18 is stored to the CPU 300 as data.

Figure 30:
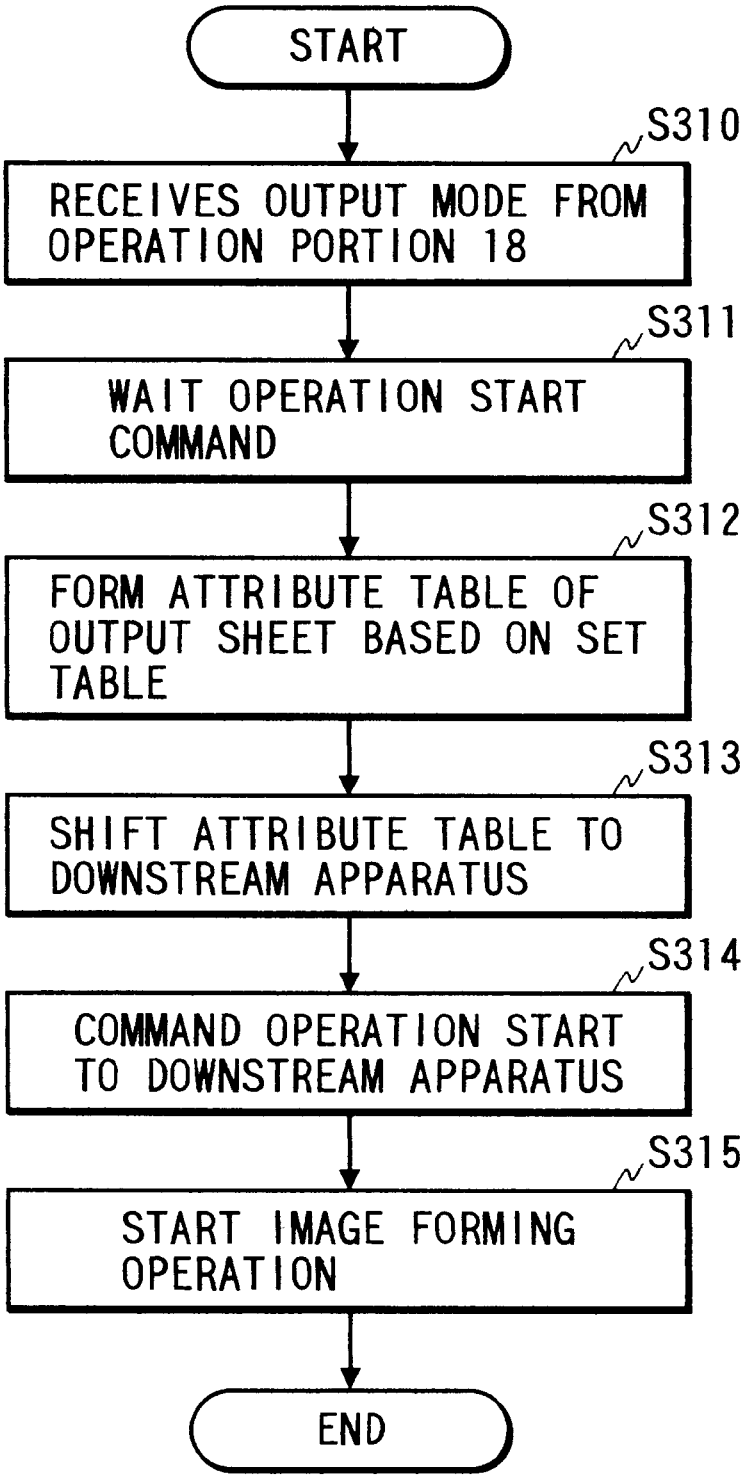
FIG. 30 is a flowchart for explaining an operation of a CPU for an image forming apparatus.

FIG. 30 is a flowchart showing an operation in which the data is stored in the CPU 300 and the data is transmitted to the CPUs 300 to 303 of the apparatuses 205, 203, 204.

First of all, the output mode is received from the operation portion 18 (step S310). Then, when operation start command is emitted (step S311), in accordance with the set mode, the attributes of the sheets in the sheet bundle are determined to form an attribute table as shown in FIG. 33 (step S312). Then, the formed attribute table is shifted to the downstream apparatuses (CPUs 300 to 303) through the communication line 304 (step S313). Then, the operation start command is sent to the downstream apparatus (step S314). Then, the image forming operation is started (step S315).

Figure 31:
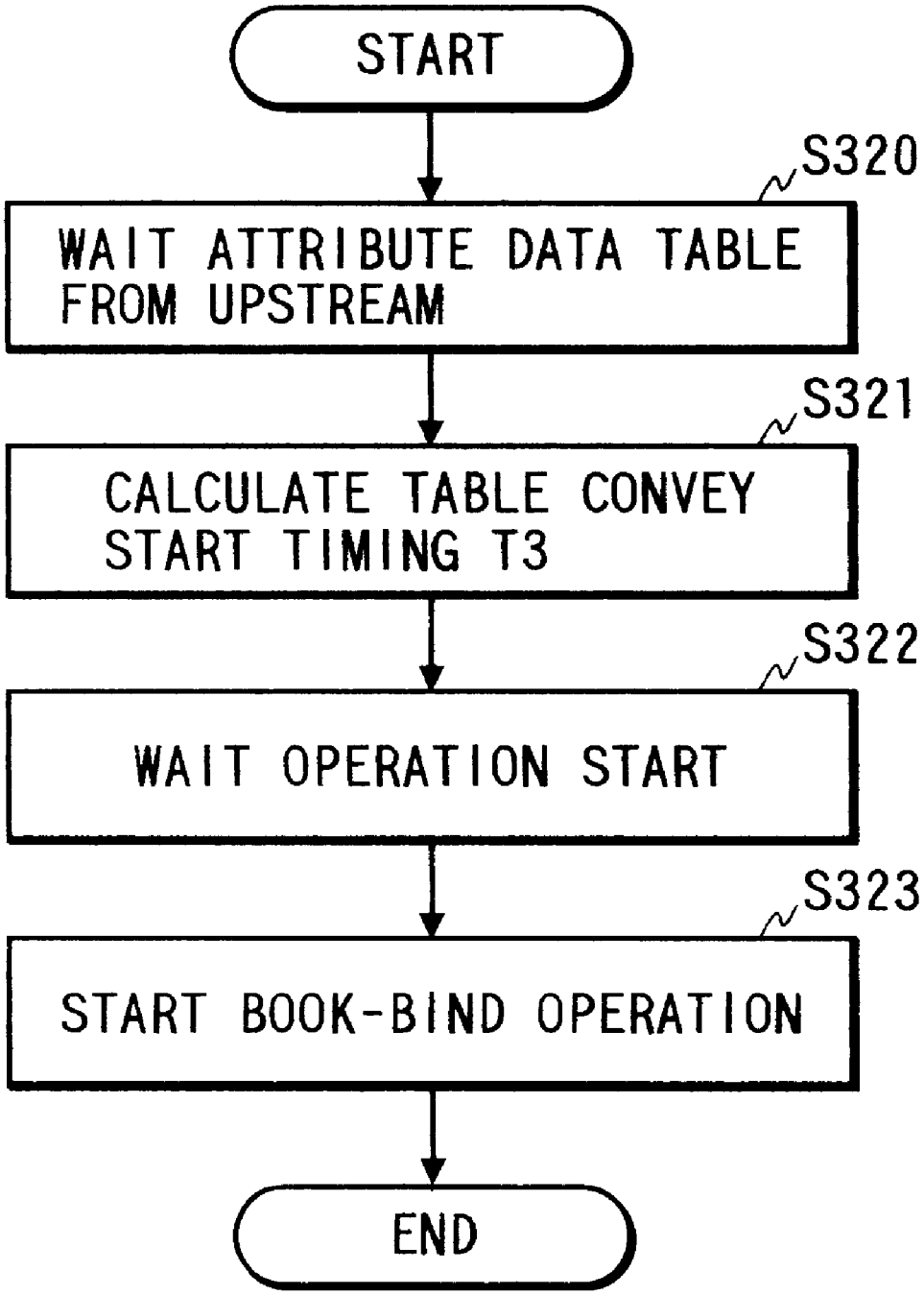
FIG. 31 is a flowchart for explaining an operation of a CPU for the book-binding apparatus.

FIG. 31 shows an operation of the CPU 302 of the book-binding apparatus.

First of all, the attribute table is received from the CPU 300 of the image forming apparatus (step S320). Then, the bind tape conveyance start timing T3 is calculated on the basis of the above equations (1) and (2) (step S321). The values of "ai" in the equation (2) are uniformly determined by the attributes of the sheets in the attribute table.

For example, the value of a5 may be determined by calculating the time duration between fourth and fifth sheets reached to the align tray 41. Both the fourth and fifth sheets are supplied from the sheet supply deck 7 with a sheet-to-sheet distance t1 depending upon a sheet feeding speed of the apparatus in an A3 lateral orientation fashion. After the image formation, the fourth sheet is sent to the book-binding apparatus 203 through the sheet Z-folding apparatus 205. On the other hand, since the fifth sheet is once passed through the both-face path 12*b*, the sheet-to-sheet distance is increased by an amount corresponding to a time duration t2 during which the fifth sheet is passed through the both-face path. Since the time period for treating the fifth sheet in the sheet Z-folding apparatus 205 is the same as the fourth sheet, the sheet-to-sheet distance is not further increased here. Accordingly, the value of a5 can be calculated on the basis of the following equation (3):

$$a5=t1+t2 \quad (3)$$

Since the values of t1, t2 are determined by fixed values depending upon a physical length and an operation time of the apparatus, these values can previously be stored. By using such values, the values of "ai" can be determined uniformly.

Then, when the operation start command is emitted from the CPU 300 of the image forming apparatus (step S322), the book-binding operation is started (step S323).

Figure 32:
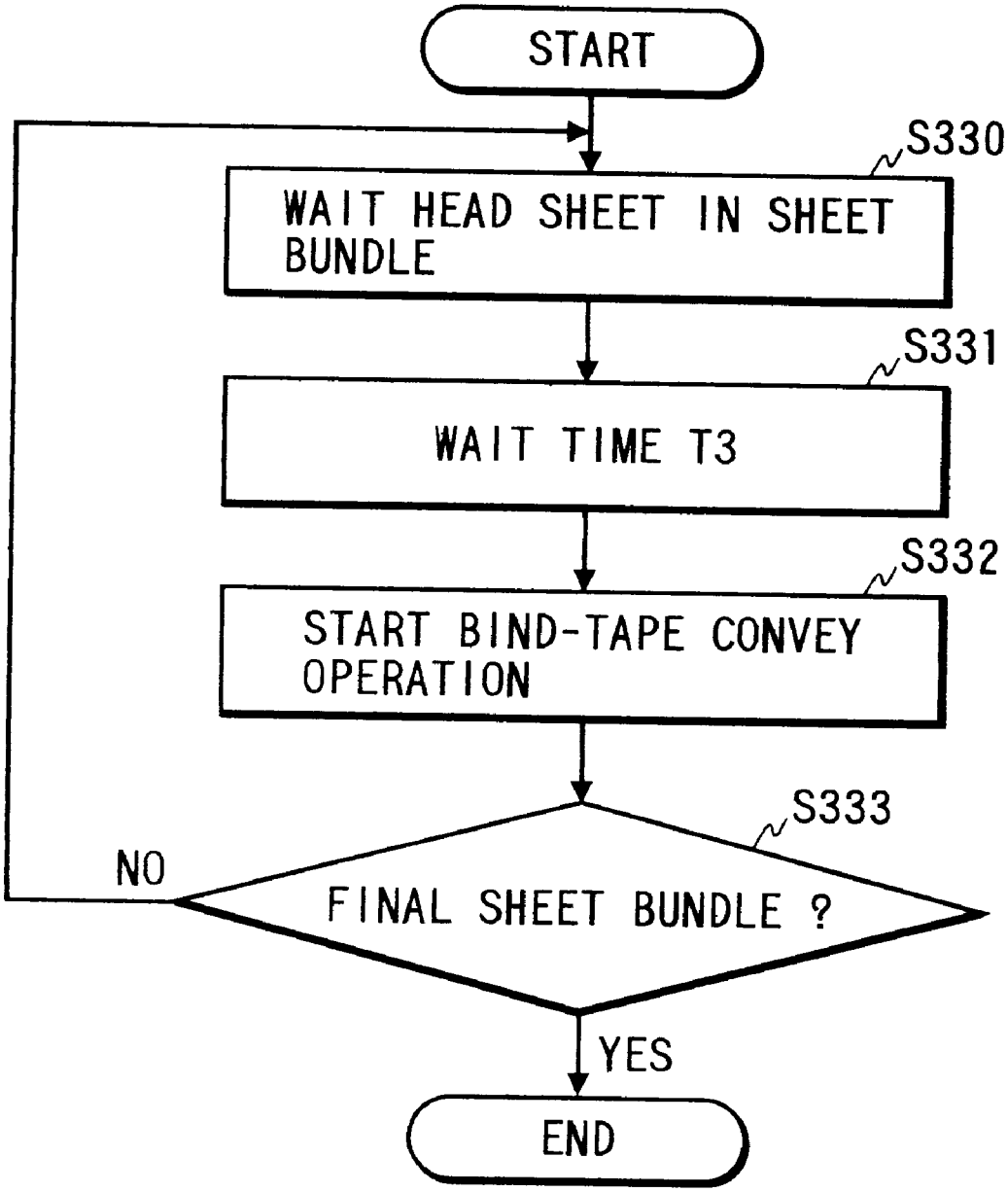
FIG. 32 is a flowchart for explaining then operation of the CPU for the book-binding apparatus in the bind tape conveyance.

FIG. 32 shows an operation of the conveyance of the bind tape. First of all, a head sheet for the sheet bundle is received in the tray 41 (step S330). Then, a waiting condition is continued until the previously calculated time period T3 is elapsed (step S331). When the time period T3 elapses, the tape conveyance operation is started (step S332). Then, it is judged whether the sheet bundle now being treated is a final sheet bundle or not (step S333). If not the final sheet bundle, the sequence is returned to the step S330; whereas, if the final sheet bundle, the sequence is ended.

As mentioned above, in the book-binding apparatus according to the present invention, since the alignment time of the sheet bundle is calculated on the basis of the attributes of the sheets in the sheet bundle and the bind tape conveyance start timing is changed in accordance with the calculated alignment time, regarding the sheet bundles including the sheets having various attributes, the productivity of the entire system is not decreased and the high quality gluing can be achieved.

By adopting the above-mentioned sequence control, the following phenomena occur.

The sheet alignment time periods T0 differ from each other due to the attribute of the sheet between the case where a first sheet bundle comprised of a plurality of sheets having first size is book-bound and the case where a second sheet bundle comprised of the same number of sheet having second size different from the first size. Further, the bind tape conveyance time period T2 is changed when the required length of the bind tape is changed. Accordingly, the time periods T3 from the initiation of the sheet alignment to the initiation of the bind tape conveyance differ from each other between the first sheet bundle and the second sheet bundle.

Similarly, the time periods T3 from the initiation of the sheet alignment to the initiation of the bind tape conveyance differ from each other due to the attribute of the sheet between the case where a first edge of a sheet bundle is glued and the case where a second edge (different from the first edge) of the sheet bundle is glued. However, the sheet is square, since the attributes of the sheets are the same, the time period T3 is not changed.

Further, the time periods T3 from the initiation of the sheet alignment to the initiation of the bind tape conveyance differ from each other due to the attribute of the sheet between the case where a first sheet bundle comprised of sheets not including any folded sheet(s) is book-bound and the case where a second sheet bundle comprised of sheets including folded sheet(s) and having the same number and size of the first sheet bundle is book-bound.

Incidentally, the sheet alignment start time is a time when the first sheet is conveyed to the sheet align tray. More specifically, the sheet alignment start time can be considered to be a time when the first sheet has just passed through a predetermined position in the vicinity of the entrance of the sheet align tray.

What is claimed is:

1. A book-binding apparatus comprising:

a heating means for heating a bind tape to melt an adhesive on the bind tape;

an align means for aligning sheets as a sheet bundle;

an abutting means for abutting the sheet bundle aligned by said align means against the bind tape to glue the sheet bundle; and a control means for controlling a heat start time of said heating means on the basis of physical properties of the sheets aligned by said align means, wherein said bind tape is glued to the sheet bundle.

2. A book-binding apparatus according to claim 1, wherein said control means controls a time period beginning from the initiation of alignment of the sheet by said align means to the heat start time of said heating means, on the basis of physical properties of the sheets.

3. A book-binding apparatus according to claim 1, wherein said control means controls the heat start time of said heating means so that the adhesive is melted by said heating means before the aligned sheet bundle is urged against the bind tape by said abutting means.

4. A book-binding apparatus according to claim 1, further comprising a convey means for conveying the bind tape to a position urged against said heating means, and wherein said heating means starts heating when said heating means contacts the bind tape.

5. A book-binding apparatus according to claim 4, wherein said control means controls a heat start time of said heating means by controlling a conveyance start time of said convey means.

6. A book-binding apparatus according to claim 5, wherein said control means controls a heat start time of said heating means by controlling a time period beginning from the initiation of the alignment of the sheet by means of said align means to the conveyance start time of said convey means.

7. A book-binding apparatus according to claim 1, wherein said control means controls a heat start time of said heating means between a case where a first sheet bundle comprised of a plurality of sheets having a first size is bound, and a case where a second sheet bundle comprising the same number of sheets having a second size different from the first size.

8. A book-binding apparatus according to claim 1, wherein said control means controls a heat start time of said heating means between a case where a first edge of the sheet bundle is glued, and a case where a second edge of the sheet bundle different from the first edge is glued.

9. A book-binding apparatus according to claim 1, wherein said control means controls a heat start time of said heating means between a case where a first sheet bundle comprising sheets not including any folded sheet is bound, and a case where a second sheet bundle comprising sheets including at least one folded sheet and having the same number and size of sheets in the first sheet bundle is bound.

* * * * *

UNITED STATES PATENT AND TRADEMARK OFFICE

CERTIFICATE OF CORRECTION

PATENT NO. : 5,899,649

DATED : May 4, 1999

INVENTOR(S) : HIDETO KOHTANI ET AL.

It is certified that error appears in the above-identified patent and that said Letters Patent is hereby corrected as shown below:

COLUMN 2:

Line 4, "melt" should read --melted--.

COLUMN 7:

Line 44, "pressure" should read --pressure to--.

COLUMN 8:

Line 49, "is" should be deleted.

Signed and Sealed this

Twenty-eighth Day of March, 2000

*Attest:*

Q. TODD DICKINSON

*Attesting Officer*

*Commissioner of Patents and Trademarks*